United States Patent [19]

Tanaka et al.

[11] Patent Number: 4,737,432

[45] Date of Patent: Apr. 12, 1988

[54] POSITIVELY CHARGEABLE TONER AND DEVELOPER FOR DEVELOPING ELECTROSTATIC IMAGES CONTAINS DI-ORGANO TIN BORATE CHARGE CONTROLLER

[75] Inventors: Katsuhiko Tanaka, Tokyo; Hirohide Tanikawa, Kawasaki; Naoto Kitamori, Yokohama; Tsutomu Kukimoto, Tokyo; Masaki Uchiyama, Ichikawa; Yasuo Mitsuhashi, Yokohama, all of Japan

[73] Assignee: Canon Kabushiki Kaisha, Tokyo, Japan

[21] Appl. No.: 906,989

[22] Filed: Sep. 15, 1986

[30] Foreign Application Priority Data

| | | | |
|---|---|---|---|
| Sep. 17, 1985 | [JP] | Japan | 60-204959 |
| Nov. 1, 1985 | [JP] | Japan | 60-245817 |
| Nov. 12, 1985 | [JP] | Japan | 60-253488 |
| Nov. 13, 1985 | [JP] | Japan | 60-254234 |
| May 28, 1986 | [JP] | Japan | 60-122644 |

[51] Int. Cl.[4] ..... G03G 9/08

[52] U.S. Cl. ..... 430/110; 430/115

[58] Field of Search ..... 430/110, 115

[56] References Cited

U.S. PATENT DOCUMENTS 4,021,407 5/1977 Gough et al. ..... 524/178

*Primary Examiner*—J. David Welsh

*Attorney, Agent, or Firm*—Fitzpatrick, Cella, Harper & Scinto

[57] ABSTRACT

A positively chargeable toner for developing electrostatic images in electrophotography, electrostatic recording, electrostatic printing, etc. The toner contains a binder resin, a colorant or magnetic material, and a diorganotin borate. Because of the diorganotin borate contained, the toner has a uniform and stable triboelectric chargeability. The improved properties of the toner are enhanced when it is combined with positively chargeable fine silica powder.

51 Claims, 3 Drawing Sheets

POSITIVELY CHARGEABLE TONER AND DEVELOPER FOR DEVELOPING ELECTROSTATIC IMAGES CONTAINS DI-ORGANO TIN BORATE CHARGE CONTROLLER

FIELD OF THE INVENTION AND RELATED ART

The present invention relates to a novel toner and a developer containing the toner for developing electrostatic images in electrophotography, electrostatic recording, electrostatic printing, etc.

Hitherto, a large number of electrophotographic processes have been known, as disclosed in U.S. Pat. Nos. 2,297,691; 3,666,363; 4,071,361, and others. In these processes, a photoconductive insulating layer is provided with a uniform electrostatic charge and is irradiated with a light image to form an electrostatic latent image, then the latent image is developed and visualized with fine powder which is called "toner" in the art, and the resultant powder image is, after transferred onto paper, etc., as desired, fixed by heating, pressing, heating-pressing rollers or solvent vapor.

The developing methods used in these electrophotographic processes may be roughly divided into the dry developing method and the wet developing method. The former is further divided into the method using a two-component type developer and the method using a one-component type developer. Methods belonging to the two-component type developing method, as classified according to the kinds of carriers for conveying a toner, include the magnetic brush method using iron powder carrier, the cascade method using head carrier, and the fur brush method using fur.

Methods belonging to the one-component type developing method include the powder cloud method using toner particles in a sprayed state; the contact developing method or the toner developing method wherein toner particles are directly contacted with an electrostatic latent image face for developing; the jumping developing method wherein toner particles are not directly contacted with an electrostatic latent image face but are charged and caused to jump onto the latent image face under an electric field provided by the electrostatic latent image; and the magnedry method wherein a magnetic electroconductive toner is contacted with an electrostatic latent image face.

As the toner to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles. The toners are provided with a positive or negative charge corresponding to the polarity of an electrostatic latent image to be developed.

In order to provide a toner with an electric charge, it is possible to utilize the triboelectric chargeability of a resin as a component of the toner but the charge provided to the toner in this way is small, so that the resultant image after development is liable to fog and be obscure. In order to provide a toner with a desired triboelectric chargeability, it has been practiced to add a dye, pigment and/or a charge controller agent capable of imparting triboelectric chargeability.

Charge controllers known in the art in these days include nigrosine and quarternary ammonium salts as controllers imparting a positive chargeability to a toner; and metal complex salts of monoazo dyes and metal complex salts of an organic acid such as salicylic acid or naphthoic acid.

These charge controllers are mainly derived from dyes or pigments, are generally complex in structure and mostly have a dense color.

Charge controllers are generally mixed with a thermoplastic resin, and the mixture is melt-kneaded, pulverized after cooling and adjusted into an appropriate size, as desired, to provide a toner.

However, these dyes as charge controllers have a complicated structure, do not have a uniform property and are little stable, so that they are liable to decompose on heat kneading, and to decompose or denaturate when subjected to mechanical impact, friction or change in temperature or humidity to cause a decrease in charge controlling characteristic. Accordingly, when a toner containing these charge controllers is used in a copying machine to effect development, the toner can cause deterioration during continual use. As another disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controllers more evenly into a resin. For example, a basic nigrosine dye is formed into a salt with a higher fatty acid for improvement of compatibility with a thermoplastic resin. In this case, however, unreacted fatty acid or the salt thereof will be exposed on the toner surfaces to contaminate carriers or toner carrying member and also cause lowering in free flowing property of the toner, fog and lowering in image density. Alternatively, for improvement in dispersibility of these dyes into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been obtained.

More specifically, when such a conventional charge controller is used in a toner, uneven or different amounts of charge are provided to individual toner particles through friction between toner particles, toner and carrier particles, or toner and a toner-carrying member such as a sleeve, whereby an undesirable phenomenon such as developing fog, toner scattering or carrier contamination is liable to occur. Such an undesirable phenomenon is pronounced when copying is repeated for a large number of times, thereby to render the toner substantially unsuitable for a high-speed copying machine providing a large number of copies.

Further, most materials known as charge controllers have a dark color and have provided a problem that they cannot be contained in a toner of a bright chromatic color.

Many charge controllers are hydrophilic and they are exposed to toner surfaces after melt-kneading and pulverization because of their poor dispersibility in resin. As a result, when the resultant toner is used under a high-humidity condition, there arises a problem that a good quality of images cannot be obtained for the reason that the charge controllers are hydrophilic.

Furthermore, many charge controllers cause a decrease in transfer efficiency of toner images and are unfit for a practical use under a high humidity condition. Even under normal temperature-normal humidity conditions, when the toner is stored for a long period, the toner can frequently cause denaturation and become unusable because of poor chargeability caused by instability of the charge controller used.

Furthermore, when such a toner containing a conventional charge controller is used for a long period, sticking of toner is promoted due to insufficient charge to result in an undesirable influence to formation of latent images (filming), or an ill effect to a cleaning step in copying operation such as formation of flaws on a photosensitive member or a cleaning member such as a cleaning blade or promotion of wearing of these members is caused. Further, some charge controller, when contained in a toner, largely affects the melt fusion characteristic of the toner to cause a decrease in fixing characteristic. Especially, a high-temperature offset characteristic can be worse to increase the tendency of paper winding about a roller when subjected to heat roller fixation, thereby lowering the serviceable life of the roller.

Thus, the use of conventional charge controllers involves many problems, the solution of which is earnestly expected in this technical field.

On the other hand, there is dissolved a method for providing a positively chargeable developer in Japanese Patent Publication No. 22447/1978. In the method, metal oxide powder treated with an aminosilane is contained in the developer as a component. As a result of our detailed investigation of the method, however, several problems have been found when powder such as that of colloidal silica, alumina, titanium dioxide, zinc oxide, iron oxide, γ-ferrite or magnesium oxide is treated with various aminosilanes. For example, a tendency of causing decrease in image density, image drop or fog has been observed.

Other methods for providing positively chargecontrollable developers are disclosed in Japanese Laid-Open Patent Appln. No. 34539/1984 (corr. to G.B. Pat. No. 2128764) and Japanese Laid-Open Patent Appln. No. 201063/1984 (corr. to U.S. Pat. No. 4,568,625). In these methods, powder of silicic acid as a kind of metal oxide is treated with a specific silane coupling agent, titanium coupling agent or a silicone oil having an amine in a side chain and is mixed with a toner, whereby developers having a further improved developing characteristic than the developer containing the above mentioned metal oxide powder treated with an aminosilane are obtained. However, a developer having a further improved developing characteristic is still desired.

Recently, according as a requirement for improvement in image quality is increased, an image forming apparatus such as an electrophotographic printer using digital image signals has been used. When a conventional positively chargeable toner is used, however, uneven or different amounts of charge provided to individual toner particles through friction between toner particles, toner and carrier particles or toner and a toner carrying member such as a sleeve, are liable to result and can provide a serious problem especially when the toner is used for developing electrostatic latent images produced by digital image signals. Where image signals are composed of digital signals, the resultant latent image is formed by a gathering of dots with a constant potential, wherein the solid, half-tone and highlight portions of the image can be expressed by varying densities of dots. Accordingly, when binary signals are used to form every portion of a picture, the picture is formed by electrostatic latent images or dots of substantially the same potential. Further, as the desire for further improved quality of picture or image has been becoming intense, the multiple-valued dither method using ternary or quaternary signals has been desired in place of the binary or two-valued dither method as described above. The multiple-valued dither method is also an essential technique in order to remove a false contour which is liable to appear in a highlight portion, or to improve a resolution by decreasing the size of one picture unit without impairing gradational characteristic, when a picture comprising halftone images and line images in mixture is reproduced simultaneously.

The concept of dither matrix in the multiple-valued dither method is explained with reference to FIGS. 1A and 1B. FIG. 1A shows a three-valued dither matrix of $2\times2$ arrangement, wherein regions $S_1$, $S_2$ and $S_3$ indicate three density levels of white, gray and black, respectively. FIG. 1B shows a four-valued dither matrix wherein regions $S_1$, $S_2$, $S_3$ and $S_4$ indicate 4 density levels of white, light gray, dark gray and black, respectively. The dot size corresponds to, e.g., 16 dots/mm. FIG. 2A and FIG. 3A show examples of exposure light intensity distributions for effecting three-valued recording in a light-scanning type electrophotographic printer, and FIGS. 2B and 3B show corresponding potential distributions of electrostatic latent images. The broken lines in FIGS. 2A and 3A represent output signals for generating a light beam for forming multiple-valued latent images. FIG. 2A shows output signals for providing a gray level (hereinafter referred to as "M level") corresponding to $S_2$ and a black level (hereinafter referred to as "H level") corresponding to $S_3$ respectively in FIG. 1A used in intensity modulation for controlling laser output. FIG. 3A shows output signals for providing M and H levels used in pulse duration modulation for controlling laser output time. This is accomplished, for example, by setting the pulse duration for the M level to one half of that for the H level. The potential distributions of latent images obtained by light beams having exposure intensity distributions shown in FIGS. 2A and 3A are as shown in FIGS. 3A and 3B, respectively, wherein the latent image contrast of the M level obtained by pulse duration modulation tends to be smaller than that of the H level because of decrease in MTF of the latent image. As a result, the image density obtained after developing the M level becomes gray which is substantially the same as that after development of the M level shown in FIG. 2B obtained by the intensity modulation.

FIG. 4 shows a developing characteristic (Vs−Dp characteristic) in a case where multiple-valued images are developed. As will be understood from FIG. 4, in order to reproduce the latent images of M and H levels in FIGS. 2B and 3B (the respective potential contrasts (i.e., potential differences from the ground level) are represented by (M) and (H) in FIG. 4), a Vs−Dp characteristic (solid line (1) in FIG. 4) having a relatively large $\gamma$ (gamma, i.e., a slope of an image density vs. latent image potential on the curve) is required, especially when a sufficiently large H level contrast is not available. However, most of the conventional toners or developers used for developing analog latent images tend to show a developing characteristic as represented by solid line (2) in FIG. 4 and have caused various problems. Thus, in order to develop a latent image composed of assembly of digital dots arranged in different densities, it is necessary to control the Vs−Vp characteristic more accurately than required for the development of conventional analog images. One requirement for developing digital images is to realize a large slope of Vs−Dp curve ($\gamma$), and another is to control the slope so as not to cause fluctuation thereof. Irregularity of charges imparted to toner particles provides an obstacle to realization of a large slope of Vs−Dp curve and is liable to cause fluctuation thereof. A Vs−Dp curve having a small slope fails to reproduce H level dots in a high density. Further, such a Vs−Dp curve also fails to fully reproduce a density difference between the H and M levels or causes a problem that peripheries of dots cannot be clearly reproduced in a resultant image because the peripheries of the latent image dots have a lower potential than the centers thereof. For these reasons, there result in poor images with low image densities, poor sharpness and/or low resolutions. The irregularity of charges of toner particles causes fluctuation or variation of the Vs−Dp curve when a copying operation is continued for a large number of sheets or when the environmental conditions are changed and leads to the above described problems to a noticeable extent.

Recently, as the OPC (organic photoconductor) photosensitive member has been improved in durability, positively chargeable toners have been applied to a copying machine with a higher copying speed than before. In such cases, a positively chargeable toner or a developer having a high durability capable of withstanding a large number of copies than before not only for development of digital latent images as described above but also for development of analog latent images.

There is a tendency that image quality problems such as ground fog, reversal fog and coarsening of images become serious in porportional with the increase in process speed and are especially noticeable in reversal fog. This phenomenon may be attributable to the fact that as the process speed increases, the chances of friction between the toner and the toner-carrying member are decreased and the duration of the friction becomes shorter, so that the toner cannot acquire a sufficient and uniform charge.

In a higher-class machine, a method of utilizing static electricity is frequently used for separating paper from a photosensitive drum after the step of transferring an image formed on the drum to the paper. In this case, a step of uniformly providing a charge of the same polarity as the developer (post charging) is added before transferring the toner from the photosensitive drum onto the paper. In such an image forming process, when a portion of the toner is present as a fog which is not transferred onto the paper in a conventional image forming process, may be transferred to the paper because a charging step is further added to provide a fog in the final image. In such an image forming process, it is necessary to control the triboelectric charge of the toner more sharply than the conventional toner, so that it is a present status that it is extremely difficult to use a conventional toner as such in a copying machine involving the post charging step.

SUMMARY OF THE INVENTION

An object of the present invention is to provide a positively chargeable toner and a developer containing the toner which can be provided with a stable amount of and a sharp and uniform distribution of triboelectric charge through friction between toner particles, between toner and carrier or between toner and a toner-carrying member such as a sleeve in case of one-component development system, and can be controlled to have a triboelectric charge in an amount adapted to a developing system to be used.

Another object of the invention is to provide a toner or developer capable of effecting development and transfer faithful to latent images. A still further object of the invention is to provide a toner or developer capable of realizing a high image density and a good reproducibility of a half tone without causing sticking of the toner to a background region, fog or scattering of the toner in the neighborhood of latent image contour during development.

A further object of the invention is to provide a developer which retains initial performances without causing agglomeration or change in charging characteristic of the toner even when the developer is continually used for a long time.

A still another object of the invention is to provide a toner which reproduces a stable image not readily be affected by change in temperature and humidity, particularly a developer having a high transfer efficiency without causing scattering or transfer drop-off during transferring under a high humidity or a low humidity.

A further object of the invention is to provide a developer with excellent storage stability which can retain initial characteristics even after a long period of storage.

A further object of the invention is to provide a bright chromatic developer.

A still further object of the invention is to provide a developer which facilitates a cleaning step without staining, abrading or flawing an electrostatic latent image-bearing surface.

Another object of the invention is to provide a developer with a good fixation characteristic, particularly a developer with no problem in respect of high-temperature offset.

Another object of the present invention is to provide a toner or developer capable of faithfully developing a digital latent image, i.e., a toner which has a large slope on a Vs−Dp curve during development, can provide a large density difference between dots and can sharply reproduce peripheries of dots.

A further object of the present invention is to provide a toner which can retain initial characteristics including a Vs−Dp curve even after a long period of successive use.

A still further object of the present invention is to provide a toner or developer which causes little fog or reversal fog even in an image forming process including a post charging step.

According to the present invention, there is provided a positively chargeable toner for developing electrostatic images, comprising a binder resin, a colorant or magnetic material, and a diorganotin borate.

The present invention further provides a developer for developing electrostatic images, comprising the above described positively chargeable toner, and positively chargeable silica powder.

The diorganotin borate used in the present invention is very excellent in controlling ability of positive charges. A principal characteristic of the present invention is that the diorganotin borate is provided to a toner as a positive charge controller.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
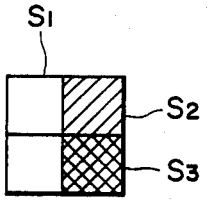
FIGS. 1A and 1B illustrate a concept of a multiple-valued dither matrix.
Figure 1B:
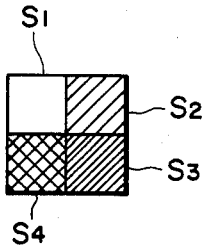
Figure 2A:
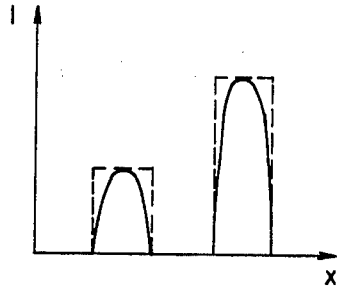
FIGS. 2A and 2B and FIGS. 3A and 3B show characteristic graphs showing exposure intensity distributions and potential distributions of electrostatic latent images for three-valued recording.
Figure 2B:
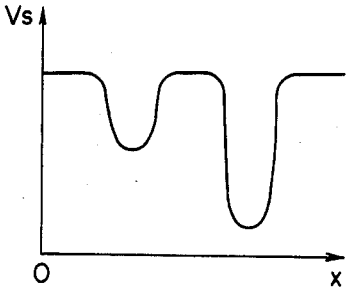

The present invention is based on our discovery that a diorganotin borate is stable both thermally and against the elapse of time, and little hygroscopic, so that it is a good positive charge controller providing a developer excellent in electrophotographic characteristics when it is contained in the developer.

More specifically, the toner containing a diorganotin borate according to the present invention, as described in the Examples appearing hereinafter, causes extremely little deterioration when subjected to successive copying, is extremely little dependent on enrivonmental conditions, and causes extremely little fog or reversal fog on images compared with a conventional positively chargeable toner. These characteristics may presumably be attributable to the fact that the diorganotin borate as a charge controller for a toner for developing electrostatic images, provides a sufficient and extremely uniform charge to individual toner particles.

Examples of the diorganotin borate used in the present invention may include those compounds represented by the following formulas:

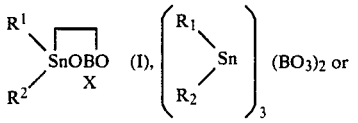

-continued

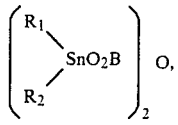

wherein $R^1$ and $R^2$ are the same or different organic groups, and X is a monovalent group.

The diorganotin borate used in the present invention has a unit or bond of

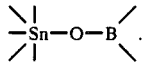

While it has not been clarified why the diorganotin borate is excellent as a positive charge controller, it is considered that biasing of charge density due to a difference in electronegativity between Sn and O plays an important role and B plays an important role of providing a sufficient thermal stability required for a charge controller for a toner. As a result, the diorganotin borate according to the invention includes a material having the above described unit as a partial structure. Examples of such materials include those compounds having a partial structure of

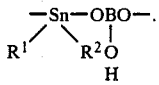

The groups $R^1$ and $R^2$ in the above formulas may be the same or different. The organic groups in the above formulas may preferably be those improving the compatibility with a binder resin and increasing the charge density around the tin atom. Examples of the organic groups include ($C_1$–$C_{20}$ alkyl groups, $C_5$–$C_{20}$ cycloalkyl groups, $C_6$–$C_{20}$ aryl groups, and $C_7$–$C_{20}$ aralkyl groups. The organic groups can have a substituted within an extent that the chargeability is not adversely affected thereby. Specific examples of the organic groups include: alkyls such as methyl, ethyl, n-butyl, iso-butyl, t-butyl, octyl and lauryl; cycloalkyls such as cyclohexyl and cyclopentyl; aryls such as phenyl, naphthyl, and anthryl; aralkyls such as benzyl and phenylethyl; and groups having the above mentioned substituent groups as scheletons.

X in the above formula denotes a monovalent group which may substantially be any one as far as it does not adversely affect the chargeability. Preferred examples of the group X include hydroxyl, alkyls, aryls, alkoxyls and aryloxyls. Among these, hydroxyl is especially preferred in view of the thermal stability of the resultant compound.

The diorganotin borate according to the present invention is thermally stable up to a temperature around 180° C., is extremely little hygroscopic and has an excellent triboelectric charge controllability, thus being a good charge controller providing a developer having excellent electrophotographic characteristics.

As will be understood from the examples appearing hereinafter, a toner for developing electrostatic images containing the diorganotin borate represented by the above formula (I) has a good transfer efficiency, is capable of providing clear images with little fog and is especially characterized in that it is hardly affected by the temperature and humidity to provide high-density images. Other characteristics are good reproducibility of half tones and little thinning of line images. Further, the diorganotin borate provides a remarkable improvement against decrease in image density with increase in number of copying when compared with known organotin compounds such as dibutyltin oxide and dioctyltin oxide. This effect is particularly remarkable when a positively chargeable dry-process silica is externally added.

Specific examples of the diorganotin borate according to the present invention are enumerated hereinbelow:

(1)

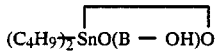

(2)

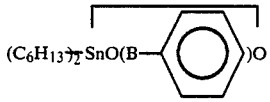

(3)

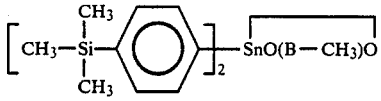

(4)

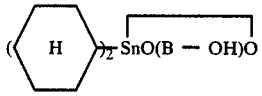

(5)

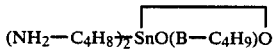

(6)

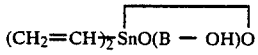

(7)

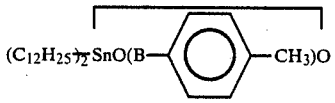

(8)

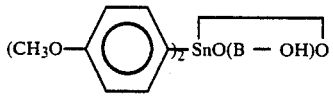

(9)

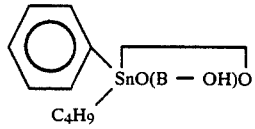

(10)

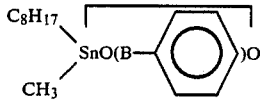

Examples of synthesis of the diorganotin borate are shown below.

A diorganotin borate having $R^1$ and $R^2$ of the same group may be synthesized by reacting tin chloride ($SnCl_2$) with a diorganomercury ($R_2Hg$) to obtain an organotin dichloride, and reacting the organotin dichloride with boric acid or an organoboric acid such as methylboric acid to cause condensation (dehydration or de-alcohol).

For example, the compound example (1) which is n-dibutyltin borate may be obtained by reacting tin chloride with dibutylmercury in ether as the solvent to obtain dibutyltin dichloride and reacting about 1 mol part of the dibutyltin dichloride after separation by filtration with about 1 mol part of boric acid to obtain a white precipitate.

A diorganotin borate having $R^1$ and $R^2$ of different groups may be synthesized in the following manner. Tin chloride ($SnCl_2$) is reacted with an organochloride to obtain an organotin trichloride, and the organotin trichloride is reacted with an organolithium having a different organic group to produce an unsymmetric organotin dichloride. About 1 mol part of the resultant unsymmetric diorganotin dichloride is reacted with about 1 mol part of boric acid or a diorganoboric acid to obtain a diorganotin borate having different $R^1$ and $R^2$ groups.

For example, the compound example (9) may be synthesized in the following manner. Tin chloride is reacted with butyl chloride to obtain butyltin trichloride, which is then dissolved in ether. The ether solution is reacted with an ether solution of phenyllithium to obtain butylphenyltin dichloride, which is, after separation by filtration, reacted with boric acid to obtain the compound (9).

Dibutyltin borate $[((C_4H_9)_2Sn)_3(BO_3)_2]$ may be produced by reacting about 3 mol parts of dibutyltin dichloride with 2 mol parts of boric acid in the presence of triethylamine in ether solvent.

Ethylmethyltin borate

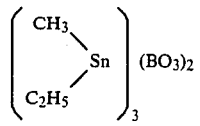

may be synthesized in the following manner. Tin chloride is reacted with methyl chloride to obtain methyltin trichloride, which is then dissolved in ether. The resultant ether solution is reacted with an ether solution of ethyllithium to obtain ethylmethyltin dichloride. About 3 mol parts of the ethylmethyltin dichloride, after separation by filtration, is reacted with about two mol parts of boric acid in the presence of triethylamine in ether solvent.

Further, the diorganotin borate according to the present invention may be produced through a dehydration reaction between a diorganotin oxide and boric acid or an organoboric acid (preferably, boric acid).

The diorganotin oxides for producing the diorganotin borate according to the present invention are represented by the formula:

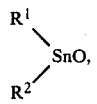

wherein $R^1$ and $R^2$ are the same or different organic groups. The organic groups are not particularly limited but may preferably be those groups functioning to increase the charge density of the tin atom. Examples thereof include $C_1$–$C_{20}$ alkyls, $C_5$–$C_{20}$ cycloalkyls, $C_6$–$C_{20}$ aryls, and $C_7$–$C_{20}$ aralkyls. The organic groups can have a substituent group. Specific examples of the organic groups include: alkyls such as methyl, ethyl, n-butyl, iso-butyl, t-butyl, octyl, and lauryl; cycloalkyls such as cyclohexyl and cyclopentyl; aryls such as phenyl, naphthyl, and anthryl; aralkyls such as benzyl and phenylethyl; and groups having the above mentioned substituent groups as scheletons.

The organoboric acids are not particularly limited either. Examples of the organoboric acids include alkylboric acids such as methylboric acid, ethylboric acid, and n-butylboric acid; and arylboric acids such as phenylboric acid and naphthylboric acid.

The condensation between a diorganotin oxide and boric acid or an organoboric acid may be example be conducted preferably in the following manner.

A diorganotin oxide and boric acid or an organoboric acid in a mol ratio of 3:1–1:3, preferably 3 mol parts of a diorganotin oxide and 2–3 mol parts of boric acid, are reacted at an elevated temperature of about 50°–about 150° C. in a solvent such as benzene, toluene, xylene or a mixture of these. The termination of the reaction may be determined with a point of time as a measure when water in an amount of nearly equal mol parts (about 0.8–1.5 mol parts) to either of the starting materials is produced.

The organotin oxide, one of the starting materials for the above reaction, per se has been known as a positive charge controller, e.g., in Japanese Patent Publications Nos. 29704/1982 (corr. to U.S. Pat. No. 4,404,270), 49864/1983, 49865/1983, and 49866/1983.

Dibutyltin oxide and dioctyltin oxide disclosed in these publications react with a resin having an acidic group on kneading at a temperature around 150° C. to lose most or the entirety of their charge controlling ability. In contrast thereto, the diorganotin borate according to the invention is stable and retains its excellent charge controlling ability even when kneaded with a resin having an acidic group at a high temperature. Further, the diorganotin borate according to the present invention is superior to the diorganotin oxides also in respect of durability or successive copying characteristic.

The positive charge controller containing the diorganotin borate as an effective component may be provided to a toner or a developer by adding the controller to the toner particles internally (incorporated inside the toner particles) or externally as by dry mixing, whereas the internal addition is preferred in view of stability against environments and durability. In the case of the internal addition, the amount of the diorganotin borate to be added may depend on several factors involved in a toner production process including kind of binder resin, optionally used additive and method of dispersion and are not determined in a single way. However, in view of chargeability and fixability, the diorganotin borate should preferably be used in a proportion of 0.1 to 20 wt. parts, more preferably 0.5 to 10 wt. parts, per 100 wt. parts of the binder resin. The diorganotin borate should preferably be in fine particulate form having a number-average particle size smaller than that of the toner, e.g., ½ or less of the number-average particle size of the toner, in view of distribution in the toner particles.

In the case of the external addition, the diorganotin borate should preferably be used in a proportion of 0.01 to 10 wt. parts per 100 wt. parts of the binder resin.

A conventional charge controller may be used in combination with the charge controller compound according to the invention as far as it does not provide a harmful effect to the toner according to the invention.

The colorant to be used in the present invention may be one or a mixture of known dyes or pigments including Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes. Generally, the colorant may be used in a proportion of 0.1–20 wt. parts, preferably 1–10 wt. parts, per 100 wt. parts of the binder resin.

The toner according to the invention may also be composed as a magnetic toner by incorporating therein a magnetic material. In this case, the magnetic material contained also functions as a colorant. The magnetic material to be contained in the magnetic toner of the invention may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium; and mixtures of these materials.

These magnetic materials may preferably be in the form of particles having an average particle size of the order of 0.1 to 2 microns, preferably 0.1–1 micron, and be used in the toner in an amount of about 20–200 wt. parts, particularly 40–150 wt. parts, per 100 wt. parts of the resin component.

The binder resin to be used in the invention may be an ordinary binder resin for toner. Examples thereof includes: homopolymers of styrene and derivatives thereof such as polystyrene, and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-acrylonitrile copolymer, styrene-vinyl methyl ether copolymer, styrene-vinyl ether copolymer, styrene-vinyl methyl ketone copolymer, styrene-butadiene copolymer, styrene-isoprene copolymer, styrene-acrylonitrile-indene copolymer, styrene-maleic acid ester copolymer and styrene-dimethylaminoethyl methacrylate copolymer; polymethyl methacrylate, polybutyl methacrylate, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, paraffin wax, etc. These binder resins may be used either singly or as a mixture. Among these, styrene resins, acrylic resins and polyester resins are especially preferred in view of developing characteristics. The above resins may be cross-linked.

The following binder resins may suitably be used singly or as a mixture, in particular, for providing a pressure-fixable toner:

Polyolefins such as low molecular-weight polyethylene, low molecular-weight polypropylene, and polyethylene oxide; waxes such as polyethylene wax and paraffin wax; epoxy resin, polyester resin, styrene-butadiene copolymer (monomer wt. ratio 5–30:95–70), olefin copolymers such as ethylene-acrylic acid copolymer, ethylene-acrylate copolymers, ethylene-methacrylic acid copolymer, ethylenemethacrylate copolymers, and ionomer resins; polyvinylpyrrolidone, methyl vinyl ether-maleic anhydride copolymer, maleic acid-modified phenolic resin, and phenol-modified terpene resin.

In the present invention, it is preferred to use a binder resin having an acid value of 0.01–50, particularly 0.05–20, in respect of anti-offset characteristic.

The resin having an acid value may be prepared by polymerization or copolymerization of a monomer having a carboxyl group, or by introducing a carboxyl group into a polymer through reaction.

Examples of the above described monomer having a carboxyl group include: acrylic acids such as acrylic acid, methacrylic acid, α-ethylacrylic acid, crotonic acid and isocrotonic acid, and their derivatives; unsaturated dicarboxylic acids such as maleic acid, fumaric acid, itaconic acid and citraconic acid and their derivatives, e.g., half esters with an alcohol having 1–20 carbon atoms; and styrene derivatives such as carboxystyrene. These monomers may be copolymerized with another known monomer. Among these, unsaturated dicarboxylic acid derivatives such as a maleic acid half ester are particularly preferred.

The content of the monomer having a carboxyl group in the polymer may be 0.01–30 wt. % to provide a good result, and is particularly preferred to be in the range of 0.05–20 wt. %. Examples of comonomers to be copolymerized with the above mentioned acidic monomer include: styrene, α-methylstyrene, vinylnaphthalene; substituted compounds of monocarboxylic acids having a double bond such as methyl acrylate, ethyl acrylate, butyl acrylate, dodecyl acrylate, octyl acrylate phenyl acrylate, methyl methacrylate, ethyl methacrylate, butyl methacrylate, octyl methacrylate, and acrylamide; diester derivatives of dicarboxylic acids having a double bond such as dibutyl maleate and dimethyl maleate; vinyl esters such as vinyl acetate and vinyl benzoate; ethylenic olefins such as ethylene, propylene and butylene; vinyl ketones such as vinyl methyl ketone and vinyl hexyl ketone; vinyl ethers such as vinyl methyl ether, vinyl ethyl ether, and vinyl isobutyl ether; aromatic divinyl compounds such as divinylbenzene and divinylnaphthalene; carboxylic acid esters having two double bonds such as ethylene glycol diacrylate, ethylene glycol dimethacrylate, and 1,3-butanediol dimethacrylate; divinyl compounds such as divinyl ether, divinyl sulfide and divinyl sulfone; and compounds having 3 or more vinyl groups. These compounds may be used singly or as a mixture.

The resin having an acid value can be crosslinked.

Further, there may be used resins having a functional group in their main chains or at the terminals thereof, e.g., polyester resins, in the present invention.

In the present invention, the combination of the diorganotin borate and the binder resin having an acid value of 0.01–50 has an effect of further stabilizing the positive triboelectric chargeability of the diorganotin borate and improving the anti-offset characteristic at the time of fixation.

The diorganotin borate used in the present invention is by itself an excellent toner charge controller and is capable of providing a good positively chargeable toner for developing electrostatic charges in combination with any resin which is generally used as a toner binder resin. However, for a use such as in the formerly described electrophotographic printer using digital signals requiring further accurate control of the triboelectric charge, it is effective to use the diorganotin borate in combination with a resin having an acid value. The combination provides a further improvement in stability of triboelectric charge during successive use, antioffset characteristic against heat rollers, and stability in triboelectric charge against environmental change.

The resin having an acid value may be mixed with a resin having substantially no acid value. The mixing ratio may depend on the magnitude of the acid value and the molecular weight of the resin. When a mixture is used, the mixing ratio in the range of 10:1–1:10 is generally preferred.

Examples of the resin having substantially no acid value include: homopolymers of styrene and substituted styrenes such as polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-vinyl methyl ether copolymer, styrene-vinyl ethyl ether copolymer, styrene-vinyl methyl ketone copolymer, styrene-butadiene copolymer, and styrene-isoprene copolymer; and silicone resins. These resins may be used singly or as a mixture. The resin having no acidic value can be crosslinked.

In the present invention, it is preferred to mix positively chargeable silica powder with the toner. As the silica powder, those produced through the dry process and the wet process may be used.

Herein, the dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention. It is preferred to use fine silica powder, of which means primary particle size is desirably within the range of from 0.001 to 2 microns, particularly preferably from 0.002 to 0.2 micron.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 80 |
| | MOX 170 |
| | COK 84 |
| Cab-O-Sil | M-5 |

-continued

| | |
|---|---|
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica powder to be used herein may be anhydrous silicon dioxide (silica), and also a silicate such as aluminum silicate, sodium silicate, potassium silicate, magnesium silicate and zinc silicate.

Commercially available fine silica powders formed by the wet process include those sold under the trade names as shown below:

Carplex (available from Shionogi Seiyaku K.K.)
Nipsil (Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuji Devison Kagaku K.K.)
Hi-Sil (Pittsuburgh Plate Glass Co.)
Durosil, Ultrasil (Füllstoff-Gesellshaft Marquart)
Manosil (hardman and Holden)
Hoesch (Chemische Fabrik Hoesch K-G)
Sil-Stone (Stoner Rubber Co.)
Nalco (Nalco Chem. Co.)
Quso (Philadelphia Quartz Co.)
Imsil (Illinois Minerals Co.)
Calcium Silikat (Chemische Fabrik Hoesch, K-G)
Calsil (Füllstoff-Gasellschaft Marquart)
Fortafil (Imperial Chemical Industries)
Microcal (Joseph Crosfield & Sons. Ltd.)
Manosil (Hardman and Holden)
Vulkasil (Farbenfabriken Bryer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.).

Among the above mentioned silica powders, those having a specific surface area as measured by the BET method with nitrogen adsorption of 30 $m^2/g$ or more, particularly 50–400 $m^2/g$, provides a good result.

Examples of adding fine silica powder formed by vapor phase oxidation of a silicon halide to a toner for electrophotography are known in the art. However, even a toner containing a dye having positive charge controlling characteristic is changed thereby to negative in its charging polarity and therefore unsuitable for visualization of negative electrostatic images or visualization of positive electrostatic images through reversal development.

In order to obtain positively chargeable silica fine powder, the above mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge when measured by the blow-off method.

The silicone oil having a nitrogen atom in its side chain may be a silicone oil having at least the following partial structure:

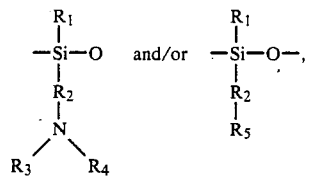

wherein $R_1$ denotes hydrogen, alkyl, aryl or alkoxyl; $R_2$ denotes alkylene or phenylene; $R_3$ and $R_4$ denotes hydrogen, alkyl, nitrogen-containing heterocyclic group, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability.

The nitrogen-containing silane coupling agent used in the present invention generally has a structure represented by the following formula:

$$RmSiYn,$$

wherein R is an alkoxy group or a halogen atom; Y is an amino group or an organic group having at least one nitrogen atom; and m and n are integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group in the silicone oil or silane coupling agent used in the present invention may be unsaturated or saturated and may respectively be known ones. Examples of the unsaturated heterocyclic ring structure providing the nitrogen-containing heterocyclic group may include the following:

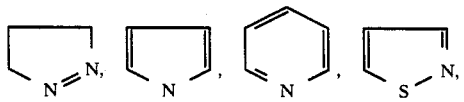

-continued

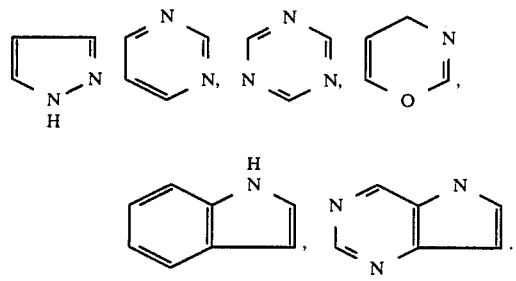

Examples of the saturated heterocyclic ring structure include the following:

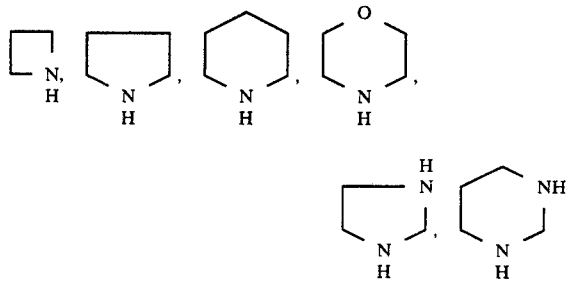

The heterocyclic groups used in the present invention may preferably be those of five-membered or six-membered rings.

Examples of the silane coupling agent include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine. Further, examples of the nitrogen-containing heterocyclic compounds represented by the above structural formulas include: trimethoxysilyl-γ-propylpiperidine, trimethoxysilyl-γ-propylmorpholine, and trimethoxysilyl-γ-propylimidazole.

The thus treated silica powder shows an effect when added in an amount of 0.01–20% and more preferably may be used in an amount of 0.03–5%, based on the developer weight, to show a positive chargeability with excellent stability. As a preferred mode of addition, the treated silica powder in an amount of 0.01–3 wt. % based on the developer weight should preferably be in the form of being attached to the surface of the toner particles.

The silica powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is preferred that the fine silica powder is treated to finally have a hydrophobicity in the range of 30–80 as measured by the methanol titration test since a developer containing the silica powder treated in this way shows a sharp and uniform triboelectric charge of a positive polarity. Herein, the methanol titration test provides a measure of the hydrophobicity of the silica fine particles having hydrophobicity-imparted surfaces.

The "methanol titration test" defined in the present invention for evaluating the hydrophobicity of the treated silica powder is conducted in the following manner. Sample fine silica powder (0.2 g) is charged into 50 ml of water in 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica powder is suspended in the liquid, and the hydrophobicity is represented by the percentage of the methanol in the liquid mixture of water and methanol on reaching the end point.

Figure 6:
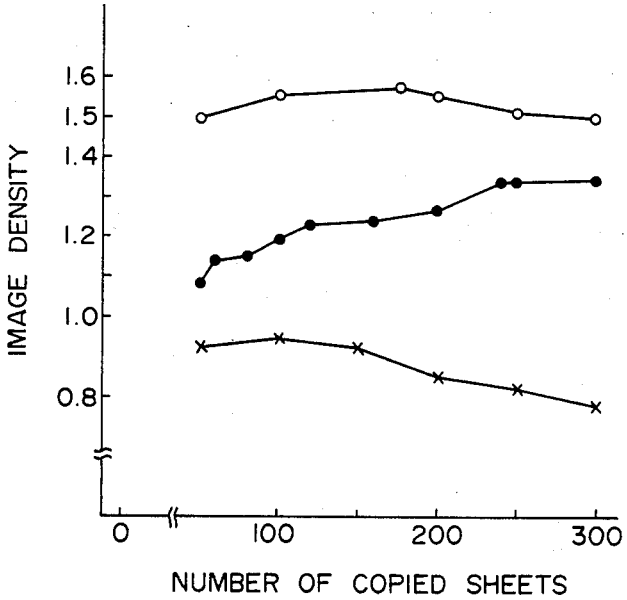
FIG. 6 is a graph showing the relationships between the image densities and the number of copied sheets obtained by using a developer according to the present invention (—○—), a developer obtained by omitting positively chargeable silica from the above developer according to the present invention, and a toner containing nigrosine.

The particularly excellent characteristic provided by a developer for developing electrostatic images obtained by adding positively chargeable silica powder to the toner containing the diorganotin borate, is that the developer does not cause a decrease in image density even when it is used continuously for a long period of time but retains a high quality of image at the initial stage. This is presumably because the developer obtained by the combination of the toner containing the diorganotin borate and the positively chargeable fine silica powder has a constant triboelectric charge, and the distribution thereof is sharp. As shown in FIG. 6, when a developer (a toner containing a diorganotin borate+positively chargeable silica powder) according to the present invention prepared in the same manner as in Example 29 appearing hereinafter, a developer obtained by removing the positively chargeable silica powder (a diorganotin borate-containing toner), and a developer consisting of a toner containing nigrosine which is widely used as a charge controller (free of positively chargeable silica powder), are compared with each other, significant differences have been observed in image density of the resultant toner images between developers of the present invention and the conventional toner.

As also observable from FIG. 9, the toner obtained by the combination of the toner containing a diorganotin borate and the positively chargeable fine silica powder provides a high performance in control of a triboelectric charge than the conventional toner.

As a result, the toner of the invention is capable of providing a high density image which is more excellent in durability and is accompanied with less fog or reversal fog than the conventional toner. Further, the toner according to the invention shows an excellent triboelectric charging characteristic to provide high quality of images even in invironments of high temperature-high humidity (32.5° C., 90%) and low temperature-low humidity (15° C., 10%).

Thus, the combination of the charge controller and positively chargeable fine silica powder given by the present invention is extremely effective in providing a sufficient and uniform triboelectric charge to individual toner particles and controlling the triboelectric charge at a high level without causing deterioration against a long period of successive use.

The toner according to the present invention may be mixed with carrier particles to form a two-component developer. Ordinarily, 0.5–50 wt. parts of the toner is mixed with 95.5 to 50 wt. parts of the carrier to provide the developer.

The carrier particles to be used in the present invention may be those known in the art including, for example, magnetic particles such as powder or particles of iron, ferrite and nickel, glass beads, and those obtained by treating these materials with a coating material such as a resin.

Another optional additive may be added externally or internally to the toner. Optional additives include, for example, lubricants such as teflon and zinc stearate; abrasives such as cerium oxide and silicon carbide; flowability improvers such as colloidal silica and aluminum oxide; anti-caking agent; conductivity-imparting agents such as carbon black and tin oxide; or fixing aids such as low molecular-weight polyethylene.

The toner for developing electrostatic images according to the present invention may be produced by sufficiently mixing the charge controller compound according to the invention with a vinyl or non-vinyl thermoplastic resin such as those enumerated hereinbefore, a pigment or dye as a colorant and, optionally, a magnetic material, an additive, etc., by means of a mixer such as a ball mill, etc.; then melting and kneading the mixture by hot kneading means such as hot rollers, kneader and extruder to disperse or dissolve the pigment or dye, the charge controller and optional additives, if any, in the melted resin; cooling and crushing the mixture; and subjecting the powder product to classification to form toner particles having an average particle size of 5 to 20$\mu$.

Alternatively, another method may be used such as a method of dispersing in a solution of the binder resin the other prescribed components and spray-drying the dispersion; a method of mixing in a monomer providing the binder resin the other prescribed ingredients to form a suspension and polymerizing the suspension to obtain a toner; or a method providing a capsule toner comprising a core and a shell, either one or both of which comprise the toner composition.

The thus obtained toner according to the present invention may be used in known manners for developing electrostatic latent images obtained by electrophotography, electrostatic recording, electrostatic printing, etc., to visualize the latent images, whereby the following remarkable effects are exhibited.

Individual particles of a toner containing diorganotin borate have a uniform triboelectric charge, and the charge is easily controlled. The resultant toner is extremely stable and does not denaturate to cause fluctuation or decrease in triboelectric charge. For the chargeability and the stabilization thereof, a chain or ring structure formed by the Sn—O—B bond is considered to play an important role. As a result, the formerly mentioned difficulties such as development fog, toner scattering and staining of an electrophotographic photosensitive material and a copier are obviated. The toner according to the present invention, because of the diorganotin borate contained therein, is free of undesirable phenomena such as agglomeration, blocking and low temperature flowing of toner during storage which are serious problems for a toner containing a conventional charge controller, and is thus capable of withstanding a long period of storage. Further, the resultant toner image is also excellent in abration resistance, fixability and adhesiveness.

Such excellent effects of the toner are even enhanced when it is applied to a repetitive transfer copying system wherein operations including charging, exposure, development and transfer are successively repeated. Further, as the diorganotin borate provides little hindrance to color hue, when the toner is used for color electrophotography, excellent chromatic color images can be provided.

The present invention will be more specifically explained with reference to examples, while it is to be understood that the present invention is not limited to the specifically described examples. In the examples, "parts" used for describing formulations are all by weights.

EXAMPLE 1

| | |
|---|---|
| Styrene/butyl methacrylate copolymer (Monomer weight ratio = 80:20, weight average molecular weight Mw = about 300,000) | 100 parts |
| Carbon black | 4 parts |
| Low-molecular weight polyethylene wax | 4 parts |
| Dibutyltin borate (Number-average particle size = about 3$\mu$) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain positively chargeable fine toner powder with particle sizes of 5–20$\mu$ and a number-average particle size of about 9$\mu$. Then, 5 parts of the toner powder was mixed with 100 parts of iron powder carrier having an average particle size of 50–80$\mu$ to prepare a developer.

Then, a negative electrostatic image was formed on an OPC (organic photoconductor) photosensitive member by a known electrophotographic technique and developed with the above prepared developer containing a positively charged toner by the magnetic brush method to form a toner image, which was transferred to plain paper and fixed by means of hot pressing rollers. The thus obtained image had a sufficiently high density and was free of fog and toner scattering around the image, thus found to be a good image with a high resolution. The above developer was used in a successive copying test for successively forming transferred images so as to check the durability, whereby transferred images after 30,000 sheets of copying were not at all inferior to those obtained at the initial stage.

Further, during the successive copying test, the "filming" phenomenon relating to the toner on the photosensitive member was not observed, nor was observed any problem during the cleaning step. The toner image was effectively transferred onto plain paper at a transfer rate of 90% or higher. No trouble was encountered in the fixing step either. After the termination of the 30,000 sheets of the successive copying test, the fixing device was observed, whereas no flaw or damage was observed on the rollers nor was observed almost any staining with offset toner, thus being practically of no problem.

Further, when the environmental conditions were changed to 35° C.-85%, clear images were obtained without fog or scattering, and the image density substantially equal to that obtained under the normal temperature-normal humidity was obtained.

Then, when transferred images were obtained under low temperature-low humidity conditions of 15° C.-10%, excellent images could be obtained with a sufficiently high image density and solid black portions could be very smoothly developed without scattering or drop-off in the central parts.

A successive copying test was conducted continuously and intermittently under these environmental conditions, whereby a density change was within ±0.2 during the copying of 30,000 sheets, and was practically sufficient.

COMPARATIVE EXAMPLE 1

A developer was prepared in the same manner as in Example 1 except that 2 parts of a nigrosine dye (Nigrosine Base EX, produced by Orient Kagaku Kogyo K.K.) was used in place of the 2 parts of dibutyltin borate, and the developer was subjected to developing, transferring and fixing. At normal temperature and normal humidity, fog occurred little, but the image density was as low as 1.06 with scattering of line images and conspicuous coarsening at the solid black portions.

When successive copying test was conducted, from the time of copying of around 10,000 sheets, the toner material began to form a film in the form of thin streaks on the photosensitive member, which appeared as lines on the images. This is a so-called "filming" phenomenon which is considered to have occurred because the charge controller changed the lubrication characteristic of the toner. Further, during the successive copying, the fixed image surface of recording paper was liable to be caught into fixing rollers and had a difficulty in pealability from the rollers.

When images were obtained under the conditions of 35° C. and 85%, the image density was lowered to 0.88 with increase of fog, scattering of the toner and coarsening of the image. The transfer efficiency was also low.

When the images were obtained under the conditions of 10° C. and 10% RH, the image density was as low as 0.91, with excessive scattering, fog an coarsening, and transfer drop-off was markedly observed.

EXAMPLE 2

A developer was prepared in the same manner as in Example 1 except that 2 parts of dicyclohexyltin borate was used in place of the 2 parts of the dibutyltin borate, and the obtained developer was similarly subjected to developing, transferring and fixing to obtain images, whereby the results as shown in Tables 1 and 2 were obtained.

EXAMPLE 3

A developer was prepared in the same manner as in Example 1 except that 2 parts of dioctyltin borate was used in place of the dibutyltin borate, and the obtained developer was similarly subjected to developing, transferring and fixing to obtain images, whereby results as shown in Tables 1 and 2 were obtained.

EXAMPLE 4

A developer was prepared in the same manner as in Example 1 except that 3 parts of di-(4-t-butylphenyl)tin borate was used in place of the dibutyltin borate, and the obtained developer was similarly subjected to developing, transferring and fixing to obtain images.

The results are also shown in Tables 1 and 2.

EXAMPLE 5

| | |
|---|---|
| Styrene/butyl methacrylate (80:20) copolymer (weight average molecular weight Mw: about 350,000) | 100 parts |
| Magnetite BL-200 (produced by Titan Kogyo K.K.) | 60 parts |
| Low-molecular weight polypropylene wax | 2 parts |
| Low-molecular weight polyethylene wax | 2 parts |
| Dibutyltin borate | 4 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with sizes of 5–20μ. Then, 0.4 part of dry-process silica treated with silicone oil having amino group was admixed with 100 parts of the fine powder as obtained above to prepare a one-component magnetic toner.

The toner was applied to a commercially available copier (Trade name: NP-150Z, mfd. by Canon K.K.) for imaging, whereby good results were obtained.

EXAMPLE 6

A developer was prepared in the same manner as in Example 5 except that 3 parts of dioctyltin borate was used in place of the dibutyltin borate, and the obtained developer was similarly subjected to developing, transferring and fixing to obtain images.

The results are also shown in Tables 1 and 2.

EXAMPLE 7

A developer was prepared in the same manner as in Example 5 except that 7 parts of dibenzyltin borate was used in place of the dibutyltin borate, and the obtained developer was similarly subjected to developing, transferring and fixing to obtain images.

The results are also shown in Tables 1 and 2.

COMPARATIVE EXAMPLE 2

A developer was prepared in the same manner as in Example 5 except that 5 parts of dibutyltin oxide was used in place of the dibutyltin borate, and the developer was subjected to developing, transferring and fixing. At normal temperature and normal humidity, fog occurred little and good images with an image density of 1.35 was obtained at the initial stage, whereas during 10,000 sheets of successive copying, the image density gradually decreased to reach a low density of 1.05 and provide noticeable fog at the time of copying 10,000 sheets.

The developer was also unsatisfactory in respects of the above mentioned filming phenomenon and the fixing performance.

EXAMPLE 8

| | |
|---|---|
| Styrene/butyl acrylate (80:20) copolymer (weight average molecular weight Mw = about 300,000) | 100 parts |
| Copper phthalocyanine blue pigment | 6 parts |
| Low-molecular weight polypropylene wax | 2 parts |
| Dibutyltin borate | 4 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain a positively chargeable powder with particle sizes of 5–20μ.

Then, 100 parts of the powder was mixed with 50 parts of magnetic particles having particle sizes of 50–80μ to prepare a developer.

Figure 7:
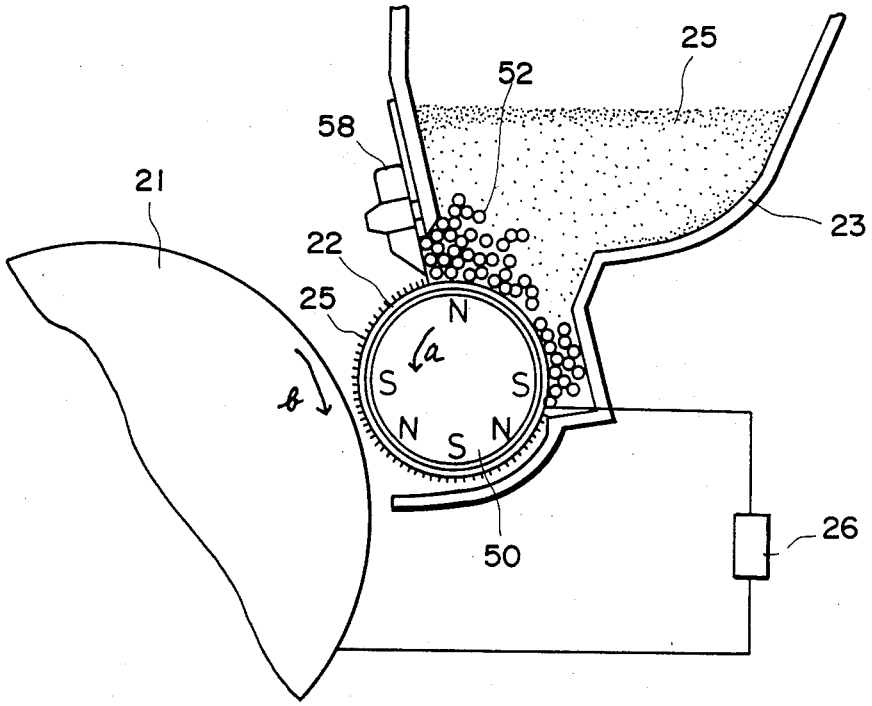
FIG. 7 illustrates a developing apparatus to which the positively chargeable toner according to the present invention may be applied.

The developer was used in a developing apparatus as shown in FIG. 7 to effect imaging.

More specifically, in the apparatus, a container 23 was provided with a cylindrical toner-carrying member 22 so that the toner-carrying member (sleeve) 22 almost blocked up the lower opening of the container 23. The toner-carrying member was made of a stainless steel cylinder with a roughened surface and rotated at a peripheral speed of 66 mm/sec in the direction of arrow a. On the other hand, at exit provide at the downstream end of the container 23 in the rotational direction of the sleeve 22, an iron blade 58 was disposed with its tip 200 microns away from the sleeve surface. Inside the sleeve 22 was disposed a fixed magnet 50 with its N pole as a major magnetic pole thereof placed at a position forming an angle $\theta$ of 30° between lines connecting the N pole and the tip of the blade 58, respectively, with the center of the sleeve 22. Under these conditions, as the sleeve 22 rotated, a magnetic brush 52 was formed with carrier iron powder contained in a developer in the container 23, and this magnetic brush 5 circulated along the surface of the sleeve at the lower part of the container 1 while taking therein a toner 25 distributed preferentially above the magnetic brush 52 and supplying the toner to the surface of the sleeve 22, thereby to form a thin layer 25 of the toner on the surface of the sleeve 22 at a position having passed by the blade 58.

In this Example, the thus formed thin layer of the toner of about 80μ in thickness was used to develop a negative electrostatic image with −600 V at a bright portion and −1500 V at a dark portion formed on a photosensitive drum 21 which was disposed opposite to and with a spring of about 300μ at the developing zone (the closest portion) from the sleeve 2 and rotated in the direction of arrow b at a peripheral speed of 60 mm/sec. At this time, an alternating bias voltage with a peak-to-peak value of 1.4 KV and a center value of −300 V and a frequency of 800 Hz was applied between the sleeve 2 and the photosensitive drum 21 by means of a power supply 26.

As a result of imaging in the manner as described above, a good image showing a clear blue color was obtained. Substantially no change in image density was observed until the tone/carrier ratio reached 10 parts/50 parts after 1500 sheets of imaging.

The results of evaluation in the above Examples and Comparative Example under the sets of conditions of the normal temperature-normal humidity (25° C.–60% RH), the high temperature-high humidity (35° C.–85% RH) and the low temperature-low humidity (15° C.–10% RH) are inclusively shown in the following Tables 1 and 2.

TABLE 1

| | | Normal temperature, Normal humidity | | | | | | |
|---|---|---|---|---|---|---|---|---|
| | | Image density | Fog | Scattering | Reproducibility of thin lines | Filming | Fixation | Image density at 30,000 sheets |
| Example | 1 | 1.45 | O | O | O | O | O | 1.41 |
| | 2 | 1.41 | O | O | O | O | O | 1.38 |
| | 3 | 1.45 | O | O | O | O | O | 1.36 |
| | 4 | 1.40 | O | O | O | O | O | 1.39 |
| | 5 | 1.45 | O | O | O | O | O | 1.41 |
| | 6 | 1.46 | O | O | O | O | O | 1.42 |
| | 7 | 1.44 | O | O | O | O | O | 1.40 |
| | 8 | 1.41 | O | O | O | O | O | 1.38 |
| | 9 | 1.41 | O | O | O | O | O | 1.41 |
| Comparative | 1 | 1.01 | O | Δ | Δ | Δ | Δ | 0.65 |
| Example | 2 | 1.31 | O | Δ | O | Δ | Δ | 0.81 |

In the above table and the tables appearing hereinafter, the symbols denote the following:
O: Good,
OΔ: Rather good,
Δ: Rather bad,
X: Bad

TABLE 2

| | | 35° C., 85% | | | 15° C., 10% | | |
|---|---|---|---|---|---|---|---|
| | | Image density | Fog | Scattering | Image density | Fog | Scattering |
| Example | 1 | 1.37 | O | O | 1.46 | O | O |
| | 2 | 1.35 | O | O | 1.43 | O | O |
| | 3 | 1.36 | O | O | 1.42 | O | O |
| | 4 | 1.36 | O | O | 1.40 | O | O |
| | 5 | 1.37 | O | O | 1.43 | O | O |
| | 6 | 1.34 | O | O | 1.42 | O | O |
| | 7 | 1.35 | O | O | 1.44 | O | O |
| | 8 | 1.36 | O | O | 1.43 | O | O |
| | 9 | 1.37 | O | O | 1.43 | O | O |
| Comparative | 1 | 0.87 | Δ | Δ | 0.90 | Δ | Δ |

TABLE 2-continued

| | | 35° C., 85% | | | 15° C., 10% | | |
|---|---|---|---|---|---|---|---|
| | | Image density | Fog | Scattering | Image density | Fog | Scattering |
| Example | 2 | 1.21 | O | Δ | 1.31 | O | X |

EXAMPLE 10

1 g of dibutyltin borate and 50 g of styrene-n-butyl methacrylate-maleic acid half ester copolymer (acid value: 19) were kneaded on a roll mill. The kneaded product was pulverized and classified to obtain fine powder with an average particle size of 15μ.

The fine powder was mixed with iron powder carrier (particle size: 250–400 mesh) and the triboelectric charge was measured at +51 μC/g by the blow-off method.

COMPARATIVE EXAMPLE 3

Fine powder was prepared in the same manner as in Example 10 and subjected to measurement of triboelectric charge except that 1 g of dibutyltin oxide was used in place of the dibutyltin borate.

The charge was −12 μC/g, and the fine powder was found to have lost positive chargeability.

EXAMPLE 11

| | |
|---|---|
| Styrene-butyl methacrylate (80:20) copolymer | 100 parts |
| Carbon black (Mitsubishi #44) | 10 parts |
| Low-molecular weight polyethylene wax | 2 parts |
| Compound (1) as described before | 2 parts |

A toner was prepared in the same manner as in Example 1 except that the above ingredients were used. Further, a copying test was conducted in the same as in Example 1 by using a developer containing the toner, whereby good results as shown in Tables 3 and 4 were obtained.

EXAMPLE 12

A developer was prepared in the same manner as in Example 11 except that 2 parts of Compound (2) was used in place of 2 parts of Compound (1), and the obtained developer was similarly subjected to developing, transferring and fixing to obtain images, whereby results as shown in Tables 3 and 4 were obtained.

EXAMPLE 13

A developer was prepared in the same manner as in Example 11 except that 3 parts of Compound (3) was used in place of 2 parts of Compound (1), and the obtained developer was similarly subjected to developing, transferring and fixing to obtain images, whereby results as shown in Tables 3 and 4 were obtained.

EXAMPLE 14

A developer was prepared in the same manner as in Example 11 except that 3 parts of Compound (4) was used in place of 2 parts of Compound (1), and the obtained developer was similarly subjected to developing, transferring and fixing to obtain images, whereby results as shown in Tables 3 and 4 were obtained.

EXAMPLE 15

| | |
|---|---|
| Styrene/butyl methacrylate (80:20) copolymer (Mw: about 350,000) | 100 parts |
| Magnetite EPT-500 (mfd. by Toda Kotyo K.K.) | 60 parts |
| Low-molecular weight polypropylene wax | 2 parts |
| Compound (1) | 5 parts |

A toner was prepared in the same manner as in Example 5 except that the above ingredients were used, and a developer was prepared from the toner and subjected to a copying test in the same manner as in Example 5, whereby good results as shown in Tables 3 and 4 shown below were obtained.

EXAMPLE 16

A developer was prepared in the same manner as in Example 15 except that 5 parts of Compound (2) was used in place of 5 parts of Compound (1), and the obtained developer was similarly subjected to developing, transferring and fixing to obtain images, whereby results as shown in Tables 3 and 4 were obtained.

EXAMPLE 17

A developer was prepared in the same manner as in Example 15 except that 7 parts of Compound (3) was used in place of 5 parts of Compound (3), and the obtained developer was similarly subjected to developing, transferring and fixing to obtain images, whereby results as shown in Tables 3 and 4 were obtained.

EXAMPLE 18

| | |
|---|---|
| Styrene-butyl methacrylate (80:20) copolymer (Mw: about 300,000) | 100 parts |
| Copper phthalocyanine pigment | 5 parts |
| Low-molecular weight polypropylene wax | 2 parts |
| Compound (1) | 2 parts |

A toner was prepared in the same manner as in Example 8 except that the above ingredients were used, and a developer was prepared from the toner and subjected to a copying test in the same manner as in Example 8, whereby results as shown in Tables 3 and 4 shown below were obtained.

EXAMPLE 19

| | |
|---|---|
| Styrene-butyl methacrylate (80:20) copolymer (Mw: about 300,000) | 100 parts |
| Copper-phthalocyanine pigment | 5 parts |
| Low-molecular weight polypropylene wax | 2 parts |
| Compound (1) | 4 parts |

A toner was prepared in the same manner as in Example 5 except that the above ingredients were used, and a developer was prepared from the toner and subjected to a copying test in the same manner as in Example 5, whereby results as shown in Tables 3 and 4 shown below were obtained.

TABLE 3

| Example | Normal temperature, Normal humidity | | | | | | |
|---|---|---|---|---|---|---|---|
| | Image density | Fog | Scattering | Reproducibility of thin lines (about 60 μ-wide) | On successive copying | | |
| | | | | | Filming | Fixation | Image density at 100,000 sheets |
| 11 | 1.45 | O | O | O | O | O | 1.43 |
| 12 | 1.44 | O | O | O | O | O | 1.43 |
| 13 | 1.46 | O | O | O | O | O | 1.44 |
| 14 | 1.32 | O | O | O | O | O | 1.33 |
| 15 | 1.43 | O | O | O | O | O | 1.44 |
| 16 | 1.41 | O | O | O | O | O | 1.40 |
| 17 | 1.44 | O | O | O | O | O | 1.42 |
| 18 | 1.40 | O | O | O | O | O | 1.38 |
| 19 | 1.42 | O | O | O | O | O | 1.41 |

TABLE 4

| Example | 35° C. 85% | | | 15° C. 10% | | |
|---|---|---|---|---|---|---|
| | Image density | Fog | Transfer efficiency | Image density | Fog | Transfer efficiency |
| 11 | 1.32 | O | O | 1.46 | O | O |
| 12 | 1.30 | O | O | 1.47 | O | O |
| 13 | 1.35 | O | O | 1.45 | O | O |
| 14 | 1.21 | O | O | 1.35 | O | O |
| 15 | 1.35 | O | O | 1.41 | O | O |
| 16 | 1.29 | OΔ | O | 1.38 | O | OΔ |
| 17 | 1.29 | O | O | 1.45 | O | O |
| 18 | 1.31 | O | O | 1.37 | O | O |
| 19 | 1.34 | O | O | 1.38 | O | O |

SYNTHESIS EXAMPLE 1

125 g of dibutyltin oxide and 31 g of boric acid were dispersed in 300 ml of toluene and subjected to dehydration under heating at 100° C. After about 6 hours of reaction, the solvent was evaporated off, warm water was added, the mixture was stirred, and excess of the boric acid was removed by filtration. The powder separated by filtration was dried to obtain 124 g of a white reaction product. The particle size of the white product was measured to provide a number-average particle size of 4.8 μm.

SYNTHESIS EXAMPLE 2

White powder obtained in the same manner as in Synthesis Example 1 was pulverized by means of a pulverizer using a jet air stream to obtain white powder with a number-average particle size of 2.9 μm. The thus obtained powder was melt-kneaded with a resin to show a good dispersibility.

EXAMPLE 20

| | |
|---|---|
| Styrene/butyl methacrylate (80:20) copolymer (Mw: about 300,000) | 100 parts |
| Carbon black | 5 parts |
| Low-molecular weight polyethylene wax | 2 parts |
| Product of Synthesis Example 1 | 2 parts |

A toner was prepared in the same manner as in Example 1 except that the above ingredients were used, and a developer was prepared from the toner and subjected to a copying test in the same manner as in Example 1, whereby results as shown in Tables 5 and 6 shown below were obtained.

EXAMPLE 21

A developer was prepared in the same manner as in Example 20 except that 2 parts of a dehydration product between dicyclohexyltin oxide and boric acid was used in place of the product of Synthesis Example 1, and the obtained developer was similarly subjected to developing, transferring and fixing to obtain images, whereby results as shown in Tables 5 and 6 were obtained.

EXAMPLE 22

A developer was prepared in the same manner as in Example 20 except that 2 parts of a condensation product between dibenzyltin oxide and methylboric acid was used in place of the product of Synthesis Example 1, and the obtained developer was similarly subjected to developing, transferring and fixing to obtain images, whereby results as shown in Tables 5 and 6 were obtained.

EXAMPLE 23

A developer was prepared in the same manner as in Example 20 except that 2 parts of a condensation product between di-(4-t-butylphenyl)tin oxide and phenylboric acid was used in place of the product of Synthesis Example 1, and the obtained developer was similarly subjected to developing, transferring and fixing to obtain images, whereby results as shown in Tables 5 and 6 were obtained.

EXAMPLE 24

| | |
|---|---|
| Styrene/butyl methacrylate (80:20) copolymer (Mw: about 350,000) | 100 parts |
| Magnetite EPT-500 (mfd. by Toda Kogyo K. K.) | 60 parts |
| Low-molecular weight polypropylene wax | 2 parts |
| Product of Synthesis Example 1 | 5 parts |

A toner was prepared in the same manner as in Example 5 except that the above ingredients were used, and a developer was prepared from the toner and subjected to a copying test in the same manner as in Example 5, whereby good results as shown in Tables 5 and 6 shown below were obtained.

EXAMPLE 25

A developer was prepared in the same manner as in Example 24 except that 3 parts of a dehydration product between dicylcohexyltin oxide and boric acid was used in place of the product of Synthesis Example 1, and the obtained developer was similarly subjected to developing, transferring and fixing to obtain images, whereby results as shown in Tables 5 and 6 were obtained.

EXAMPLE 26

A developer was prepared in the same manner as in Example 24 except that 6 parts of a condensation product between dibenzyltin oxide and methylboric acid was used in place of the product of Synthesis Example 1, and the obtained developer was similarly subjected to developing, transferring and fixing to obtain images, whereby results as shown in Tables 5 and 6 were obtained.

EXAMPLE 27

| | |
|---|---|
| Styrene/butyl acrylate (80:20) copolymer (Mw: about 300,000) | 100 parts |
| Copper-phthalocyanine pigment | 5 parts |
| Low-molecular weight polypropylene wax | 2 parts |
| Product of Synthesis Example 1 | 4 parts |

A toner was prepared in the same manner as in Example 8 except that the above ingredients were used, and a developer was prepared from the toner and subjected to a copying test in the same manner as in Example 8, whereby good results as shown in Tables 5 and 6 shown below were obtained.

EXAMPLE 28

| | |
|---|---|
| Styrene/butyl acrylate (80:20) copolymer (Mw: about 300,000) | 100 parts |
| Copper-phthalocyanine pigment | 5 parts |
| Low-molecular weight polypropylene wax | 2 parts |
| Product of Synthesis Example 1 | 4 parts |

A toner was prepared in the same manner as in Example 9 except that the above ingredients were used, and a developer was prepared from the toner and subjected to a copying test in the same manner as in Example 9, whereby good results as shown in Tables 5 and 6 shown below were obtained.

TABLE 5

| | Normal temperature, Normal humidity | | | | | | |
|---|---|---|---|---|---|---|---|
| Example | Image density | Fog | Scattering | Reproducibility of thin lines | Filming | Fixation | Image density at 30,000 sheets |
| 20 | 1.42 | O | O | O | O | O | 1.41 |
| 21 | 1.38 | O | O | O | O | O | 1.36 |
| 22 | 1.37 | O | O | O | O | O | 1.36 |
| 23 | 1.39 | O | O | O | O | O | 1.39 |
| 24 | 1.45 | O | O | O | O | O | 1.43 |
| 25 | 1.37 | O | O | O | O | O | 1.35 |
| 26 | 1.39 | O | O | O | O | O | 1.38 |
| 27 | 1.38 | O | O | O | O | O | 1.35 |
| 28 | 1.41 | O | O | O | O | O | 1.40 |

TABLE 6

| | 35° C., 85% | | | 15° C., 10% | | |
|---|---|---|---|---|---|---|
| Example | Image density | Fog | Scattering | Image density | Fog | Scattering |
| 20 | 1.35 | O | O | 1.43 | O | O |
| 21 | 1.33 | O | O | 1.40 | O | O |
| 22 | 1.33 | O | O | 1.41 | O | O |
| 23 | 1.34 | O | O | 1.40 | O | O |
| 24 | 1.36 | O | O | 1.44 | O | O |
| 25 | 1.32 | OΔ | O | 1.41 | O | OΔ |
| 26 | 1.31 | O | O | 1.40 | O | O |
| 27 | 1.32 | O | O | 1.41 | O | O |
| 28 | 1.35 | O | O | 1.42 | O | O |

EXAMPLE 29

| | |
|---|---|
| Styrene/butyl methacrylate (80:20) copolymer (Mw: about 300,000) | 100 parts |
| Magnetite | 60 parts |

-continued

| | |
|---|---|
| Low-molecular weight polyethylene wax | 4 parts |
| Dibutyltin borate | 5 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain black fine powder (used as a toner) with a number-average particle size of 10μ.

On the other hand, silica fine powder synthesized through the dry process (Trade name: Aerosil#200, specific surface area: about 200 $m^2/g$, mfd. by Nippon Aerosil K.K.) was treated with a silicone oil having a primary amine in its side chain (nitrogen atom equivalent: 830, viscosity at 25° C.: 80 cps) to obtain positively chargeable silica fine powder. The silicone oil had the following structure as a partial structural unit:

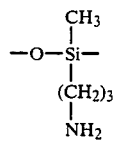

0.5 wt. part of the thus treated silica fine powder was added to 100 wt. parts of the toner (black fine powder) to obtain a developer.

The developer was evaluated by applying it to an electrophotographic printer using a photosensitive member of amorphous silicon to obtain images. The developer showed a triboelectric charge of +10.5 μC/g as measured by the blow-off method.

Figure 5:
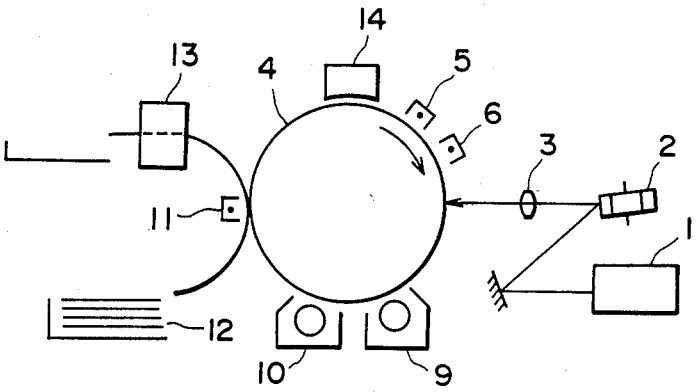
FIG. 5 illustrates an embodiment of an electrophotographic printer to which the toner according to the invention is applied.

In FIG. 5 is shown an electrophotographic printer to which the present invention is applicable and which was used in this Example. An electric signal was put into a laser modulating unit 1 and put out as a modulated laser beam, which was then passed through a scanner mirror 2 and an f-θ lens 3 to scan a photosensitive drum 4 along the lengthwise direction thereof. The photosensitive drum 4 was rotated in the direction of an arrow whereby the laser beam could be irradiated to scan the drum two-dimensionally.

Figure 3A:
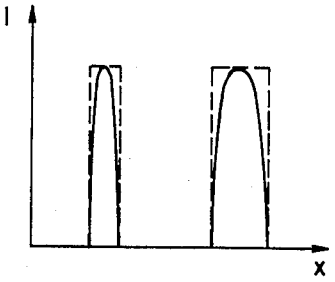
Figure 3B:
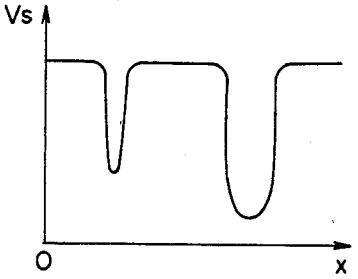
Figure 4:
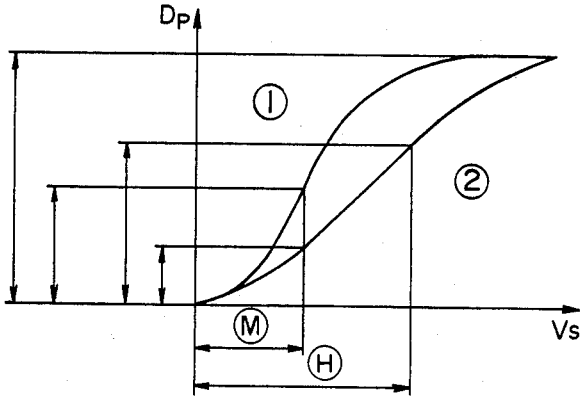
FIG. 4 shows a graph showing developing characteristics of multiple-valued latent images.

The photosensitive drum 4 may comprise a photosensitive material such as amorphous silicon, selenium, CdS or an organic conductor, which has been sensitized to have a sensitivity in the wavelength range of, e.g., a semiconductor laser beam (780–800 nm). In this example, an amorphous silicon photoconductor was used to form the photosensitive drum 4. The surrace potential of the photosensitive drum 4 was smoothed by an AC charge remover 5, and then the drum 4 was charged to 380 V by a charger 6. Thereafter, the drum 4 was subjected to laser beam exposure by image-scanning scheme to form thereon dot latent images by a three-valued dither method. M level among the three values or levels was provided by pulse duration modulation of the laser beam as shown in FIG. 3A. The latent image potentials were 250 V for H level and 120 V for M level.

The thus obtained dot latent images were reversely developed with the above mentioned developer containing the toner contained in a developer 9 or 10 for one-component insulating magnetic toner under the application of a DC bias of 280 V.

The thus developed toner image was then transferred onto a transfer paper 12 by means of a transfer charger 11 and fixed onto the transfer paper 12 by means of a fixer 13. The toner remaining on the photosensitive drum without transfer was collected by a cleaner 14. The image formed on the transfer paper showed image densities of 1.51 corresponding to H level and 0.65 for M level, thus providing a sufficiently high image density at a solid image portion, with sharp separation between dots and could beautifully reproduce a photographic image which can be a measure for evaluation of capability of reproducing a half tone. When 100,000 sheets of continuous copying was conducted, the fluctuation in image density for H level was within ±0.07 and within ±0.15 for M level, so that a remarkable variation was not observed in the Vs−Dp characteristic. Further, when the environmental conditions were changed to 35° C. and 80%, and 15° C. and 10%, respectively, good images were obtained as under the normal temperature and normal humidity conditions, and the performances did not change remarkably during a successive copying operation of 100,000 sheets.

This developer did not cause a remarkable change in performances from the initial ones even after a storage for a half year.

During the successive copying test, there was observed no problem in respect of fog or reversal fog.

EXAMPLES 30-34

Developers were obtained in the same manner as in Example 29 except that the dibutyltin borate and the positively chargeable silica fine powder were replaced by the diorganotin borates and the treated silica fine powders shown in Table 7. The resultant developers were evaluated by forming images in the same manner as in Example 29. The results are shown in Table 8.

TABLE 7*

| | Diorganotin borate | | Treated silica powder | | | | |
|---|---|---|---|---|---|---|---|
| Example No. | Name | Rate of addition to toner (wt. %) | Raw silica powder | Treating agent | Rate of treatment (wt. %) | Hydro-phobicity | Rate of addition to developer (wt. %) |
| 30 | dicyclohexyltin borate | 4 | Aerosil #200 | silicone oil A *1 | 15 | 60 | 0.5 |
| 31 | dioctyltin borate | 2 | Aerosil #200 | silicone coupling agent A *2 | 5 | 50 | 0.4 |
| 32 | dibenzyltin borate | 6 | Aerosil #200 | silicone oil B *3 | 15 | 62 | 0.5 |
| 33 | di-t-butylphenyl-tin borate | 7 | Aerosil #300 | silicone coupling agent B *4 | 5 | 50 | 0.4 |
| 34 | di-(trimethyl-silylphenyl)tin borate | 7 | Aerosil #300 | silicone oil C *5 | 15 | 61 | 0.4 |

*Remarks to Table 7

The treating agents shown in Table 7 have the following nature:

*1: Silicone oil A:

Having the following partial structure including a nitrogen-containing group:

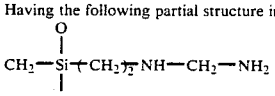

*2: Silicone coupling agent A:

Comprising 3 wt. % of a silane coupling agent of the following structure and 2 wt. % of dimethyldichlorosilane:

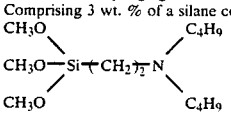

*3: Silicone oil B:

Having the following partial structure including a nitrogen-containing organic group:

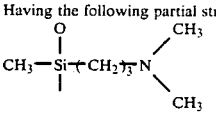

*4: Silane coupling agent B:

Comprising 3 wt. % of a silane coupling agent of the following structure and 2 wt. % of dimethyldichlorosilane:

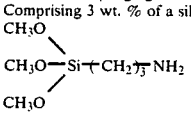

*5: Silicone oil C:

Having the following partial structure including a nitrogen-containing organic group:

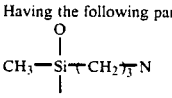

TABLE 8

| Example No. | Image density at H level | Image density at M level |
|---|---|---|
| 30 | 1.41 | 0.60 |
| 31 | 1.45 | 0.72 |
| 32 | 1.40 | 0.59 |
| 33 | 1.42 | 0.62 |
| 34 | 1.41 | 0.58 |

Further to say, during the successive copying tests of these developers, the maximum change in image density was within ±0.1 at H level and within ±0.12 at M level, so that practically no problem was recognized. During the successive tests, there were observed no problems in respect of fog or reversal fog, and clear images were obtained.

Further, when the environmental conditions were changed to 35° C.-85% and 15° C.-10%, similarly good results were obtained in any of the conditions.

EXAMPLE 35

Example 29 was repeated except that styrenebutyl methacrylate-dimethylaminoethyl methacrylate (wt. ratio=7:2.5:0.5) copolymer was used in place of the styrene-butyl methacrylate copolymer. The resultant images showed an image density of 1.42 at H level and 0.63 at M level. The solid image portion provided a sufficiently high image density and dots were sharply separated. Further, a photographic image as a measure for half tones could be beautifully reproduced.

When 100,000 sheets of continuous copying was conducted, the density fluctuation was within ±0.07 at H level and ±0.15 at M level, so that a substantial variation in the Vs−Dp characteristic was not observed. Further, when the environmental conditions were changed to 35° C.-80% and 15° C.-10%, good images were also obtained in respective cases similarly as under the normal temperature-normal humidity conditions, and the performances did not practically change during a successive copying operation of 100,000 sheets. Further, increase in reversal fog was not observed either throughout the successive copying.

EXAMPLE 36

Example 29 was repeated except that 50 parts of γ-iron oxide was used in place of 60 parts of the magnetite. The resultant sepia images showed an image density of 1.35 at H level and 0.61 at M level. The solid image portion provided a sufficiently high image density and dots were sharply separated. Further, a photographic image as a measure for half tones could be beautifully reproduced.

When 100,000 sheets of continuous copying was conducted, the density fluctuation was within ±0.07 at H level and ±0.15 at M level, so that a substantial variation in the Vs−Dp characteristic was not observed. Further, when the environmental conditions were changed to 35° C.-80% and 15° C.-10%, good sepia images were also obtained in respective cases similarly as under the normal temperature-normal humidity conditions, and the performances did not practically change during a successive copying operation of 100,000 sheets. Further, increase in several fog was not observed either throughout the successive copying.

EXAMPLE 37

| | |
|---|---|
| Styrene/butyl methacrylate (80:20) copolymer (Mw: about 300,000) | 100 parts |
| Carbon black | 5 parts |
| Low-molecular weight polypropylene wax | 2 parts |
| Dibutyltin borate | 3 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder (used as a toner) with particle sizes of 5–20μ. To the fine powder was externally added 0.4 wt. % of the positively chargeable silica fine powder used in Example 29.

5 parts of the thus mixed powder was further mixed with 100 parts of iron powder carrier having an average particle size of 50–80μ to prepare a developer.

Then, a negative electrostatic image was formed on an OPC photosensitive member by a known electrophotographic technique and developed with the above prepared developer by the magnetic brush method to form a toner image, which was transferred to plain paper and fixed by means of hot pressing rollers. The thus obtained image had a sufficiently high density of 1.45 and was free of fog at all and toner scattering around the image, thus found to be a good image with a high resolution.

The developer was used in a successive copying test, during which the above-mentioned phenomenon of "filming" on the photosensitive member was not observed, nor was observed any problem during the cleaning step. No trouble was encountered in the fixing step either. After the termination of the 100,000 sheets of the successive copying test, the fixing device was observed, whereas no flaw or damage was observed on the rollers nor was observed almost any staining with offset toner, thus being practically of no problem.

Further, when the environmental conditions were changed to 35° C.-85%, clear image were obtained without fog or scattering, and the images density of 1.35 substantially equal to that obtained under the normal temperature-normal humidity was obtained.

Then, when transferred images were obtained under low temperature-low humidity conditions of 15° C.-10%, excellent images could be obtained with a high image density of 1.42 and solid black portions could be very smoothly developed without scattering or drop-off in the central parts.

EXAMPLES 38–42

Developers were prepared in the same manner as in Example 37 except that the dibutyltin borate and the positively chargeable silica fine powder used therein were respectively and successively replaced by the diorganotin borates and the treated silica powders shown in Table 7 described before. The resultant developers were evaluated by forming images in the same manner as in Example 37. The results are shown in the following Table 9.

TABLE 9

| Example No. | Image density at initial stage | Image density on successive copying |
|---|---|---|
| 38 | 1.36 | 1.34 |
| 39 | 1.44 | 1.44 |
| 40 | 1.34 | 1.31 |
| 41 | 1.38 | 1.35 |
| 42 | 1.41 | 1.42 |

Further, when the environmental conditions were changed to 35° C.-85% and 15° C.-10%, good images similar to those obtained under the normal temperature-normal humidity conditions were obtained.

Throughout the successive copying tests, there was observed no problem at all with respect to fog or reversal fog, nor was observed any filming phenomenon.

COMPARATIVE EXAMPLE 4

A developer was prepared in the same manner as in Example 40 except that 3 parts of dibutyltin oxide $(C_4H_9)_2SnO$) was used in place of the dibenzyltin borate, and the developer was evaluated by imaging as in Example 40. At the initial stage, images with a density of 1.30 were obtained, but the image density was lowered to 0.85 and conspicuous fog was observed already at the time of copying 10,000 sheets.

EXAMPLE 43

| | |
|---|---|
| Styrene/butyl methacrylate (80:20) copolymer (Mw: about 350,000) | 100 parts |
| Magnetite | 60 parts |
| Low-molecular weight polypropylene wax | 2 parts |
| Low-molecular weight polyethylene wax | 2 parts |
| Dibutyltin borate | 5 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain black powder with an average particle size of 10 μ.

To 100 parts of the above powder was added 0.4 part of the positively chargeable silica powder to obtain a developer. The developer was evaluated by imaging in the same manner as in Example 29, whereby good results similarly as in Example 29 was obtained.

EXAMPLE 44

| | |
|---|---|
| Styrene/butyl methacrylate/maleic acid n-butyl half ester (80:19:1 by weight) copolymer (MW: about 300,000, acid value: 3) | 100 parts |
| Magnetite | 60 parts |
| Low-molecular weight polyethylene wax | 4 parts |
| Dibutyltin borate | 5 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain black fine powder (used as a toner) with a number-average particle size of 10 μ.

The fine powder was mixed with 0.5 wt. % of positively chargeable hydrophobic silica by means of a sample mill to prepare a one-component magnetic toner.

The developer was evaluated by imaging by means of an electrophotographic printer using an amorphous silicon photosensitive member in the same manner as in Example 29.

The image formed on the transfer paper showed image densities of 1.48 corresponding to H level and 0.67 for M level, thus providing a sufficiently high image density at a solid image portion, with sharp separation between dots and could beautifully reproduce a photographic image which can be a good measure for evaluation of capability of reproducing a half tone. When 100,000 sheets of continuous copying was conducted, the fluctuation in image density for H level was within ±0.07 and within ±0.15 for M level, so that a remarkable variation was not observed in the Vs−Dp characteristic. Further, when the environmental conditions were changed to 35° C. and 80%, and 15° C. and 10%, respectively, good images were obtained as under the normal temperature and normal humidity conditions, and the performances did not change remarkably during a successive copying operation of 100,000 sheets.

This developer did not cause a remarkable change in performances from the initial ones even after a storage for a half year.

During the successive copying test, there was observed no problem in respect of fog, reversal fog or offset characteristic.

EXAMPLE 45

| | |
|---|---|
| Styrene/butyl methacrylate/maleic acid n-butyl half ester copolymer (Mw: about 300,000, acid value: 5) | 100 parts |
| Magnetite | 60 parts |
| Low-molecular weight polypropylene wax | 2 parts |
| Low-molecular weight polyethylene wax | 4 parts |
| Dioctyltin borate | 3 parts |

From the above ingredients, black fine powder was obtained in the same manner as in Example 44, and the black powder was mixed with 0.4 wt. % of positively chargeable silica by means of a sample mill to prepare a one component magnetic toner.

The toner was evaluated by imaging in the same manner as in Example 44, whereby good results similarly as in Example 44 was obtained.

EXAMPLE 46

| | |
|---|---|
| Styrene/butyl methacrylate/maleic acid n-butyl half ester copolymer (Mw: about 400,000, acid value: 1) | 100 parts |
| γ-iron oxide | 50 parts |
| Low-molecular weight polyethylene wax | 4 parts |
| Dicyclohexyltin borate | 6 parts |

From the above ingredients, sepia fine powder was obtained in the same manner as in Example 44, and the sepia powder was mixed with 0.5 wt. % of positively chargeable silica by means of a sample mill to prepare a one component magnetic toner.

The toner was evaluated by imaging in the same manner as in Example 44.

The resultant sepia image showed image densities of 1.35 at H level and 0.61 at M level, thus providing a sufficiently high image density at a solid image portion, with sharp separation between dots and could beautifully reproduce a photographic image which can be a measure for evaluation of capability of reproducing a half tone. When 100,000 sheets of continuous copying was conducted, the fluctuation in image density for H level was within ±0.07 and within ±0.15 for M level, so that a remarkable variation was not observed in the Vs−Dp characteristic. Further, when the environmental conditions were changed to 35° C. and 80%, and 15° C. and 10%, respectively, good sepia images were obtained as under the normal temperature and normal humidity conditions, and the performances did not change remarkably during a successive copying operation of 100,000 sheets. Throughout the successive copying, no increase in reversal fog was observed either.

EXAMPLE 47

| | |
|---|---|
| Styrene/butyl methacrylate/methacrylic acid copolymer (Mw: about 300,000, acid value: 18) | 100 parts |
| Carbon black | 5 parts |
| Low-molecular weight polyethylene wax | 2 parts |
| Di(p-ethylbenzyl)tin borate | 7 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain black fine powder (used as a toner) with particle sizes of 5–20μ.

The fine powder was externally mixed with 0.4 wt. % of positively chargeable silica powder.

5 parts of the thus mixed powder was further mixed with 100 parts of iron powder carrier having an average particle size of 50–80μ to prepare a developer.

Then, a negative electrostatic image was formed on an OPC photosensitive member by a known electrophotographic technique and developed with the above prepared developer by the magnetic brush method to form a toner image, which was transferred to plain paper and fixed by means of hot pressing rollers. The thus obtained image had a sufficiently high denisty of 1.28 and was free of fog at all and toner scattering around the image, thus found to be a good image with a high resolution.

The developer was used in a successive copying test, during which the above-mentioned phenomenon of "filming" on the photosensitive member was not observed, nor was observed any problem during the cleaning step. No trouble was encountered in the fixing step either. After the termination of the 100,000 sheets of the successive copying test, the fixing device was observed, whereas no flaw or damage was observed on the rollers nor was observed almost any staining with offset toner, thus being practically of no problem.

Further, when the environmental conditions were changed to 35° C.–85%, clear images were obtained without fog or scattering, and the image density of 1.20 substantially equal to that obtained under the normal temperature-normal humidity was obtained.

Then, when transferred images were obtained under low temperature-low humidity conditions of 15° C.–10%, excellent images could be obtained with a high image density of 1.26 and solid black portions could be very smoothly developed without scattering or drop-off in the central parts.

EXAMPLE 48

A toner was prepared in the same manner as in Example 47 except that styrene/butyl methacrylate/ maleic acid n-butyl half ester and 2 parts of didodecyltin borate were used in place of the corresponding ingredients. The toner was evaluated by imaging in the same manner as in Example 47, whereby good images with a somewhat higher image density than in Example 47 were obtained.

COMPARATIVE EXAMPLE 5

A toner was prepared in the same manner as in Example 47 except that 3 parts of dibutyltin oxide ($(C_4H_9)_2SnO$) was used in place of the di(p-ethylbenzyl)tin borate, and the developer was evaluated by imaging as in Example 47. At the initial stage, images with a density of 1.29 were obtained, but the image density was lowered to 0.72 and conspicuous fog was observed already at the time of copying 10,000 sheets.

EXAMPLE 49

| | |
|---|---|
| Copolymer used in Example 44 | 100 parts |
| Copper-phthalocyanine pigment | 5 parts |
| Dibutyltin borate | 3 parts |
| Low-molecular weight polyethylene wax | 3 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 μ.

Then, the fine powder was mixed with 0.5 wt. % of silica by means of a sample mill to prepare a toner, 100 parts of which was then mixed with 50 parts of magnetic particles with sizes of 50–80μ to prepare a developer.

The toner in mixture with the magnetic particles was applied to a commercially available copier (Trade name: PC-22 mfd. by Canon K.K.) to effect imaging, whereby clear blue images with an image density of 1.37 were obtained with satisfactory clearness of images. When 2000 sheets of copying was repetitively conducted, the image density was almost free of change at 1.33, and no decrease in image sharpness was observed. Further, when copying environments were changed to 35° C.–85% and 15° C.–10%, good images were obtained in any case similarly as under normal temperature-normal humidity conditions.

EXAMPLE 50

| | |
|---|---|
| Styrene/butyl methacrylate/maleic acid n-butyl half ester/divinylbenzene copolymer (Mw = about 400,000, acid value = 12) | 50 parts |
| Styrene/2-ethylhexyl acrylate/divinylbenzene copolymer (Mw = about 250,000) | 50 parts |
| Magnetite | 70 parts |
| Low-molecular weight polyethylene wax | 4 parts |
| Dibutyltin borate | 4 parts |

A toner was prepared in the same manner as in Example 47 except that the above ingredient composition was used. The toner was evaluated by imaging in the same manner as in Example 47, whereby good fixed images similar to those obtained in Example 48 were obtained.

What is claimed is:

1. A positively chargeable toner for developing electrostatic images, comprising a colored dye, colored pigment or magnetic material, a diorganotin borate and a binder resin selected from the group consisting of styrene homopolymers, styrene derivative homopolymers, styrene copolymers, acrylic resins and polyester resin.

2. A toner according to claim 1, wherein the diorganotin borate has a partial structure of

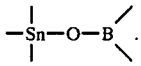

3. A toner according to claim 2, wherein the diorganotin borate has a partial structure of

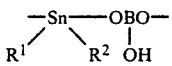

wherein $R^1$ and $R^2$ denote the same or different organic groups.

4. A toner according to claim 3, wherein $R^1$ and $R^2$ denote an alkyl having 1–20 carbon atoms, a cycloalkyl having 5–20 carbon atoms, an aryl having 6–20 carbon atoms, or an aralkyl having 7–20 carbon atoms.

5. A toner according to claim 1, wherein the diorganotin borate comprises a compound selected from the group consisting of those represented by the following formulas:

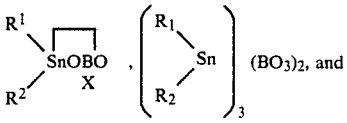

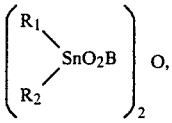

wherein $R^1$ and $R^2$ denote the same or different organic groups, and X denotes a monovalent group.

6. A toner according to claim 5, wherein $R^1$ and $R^2$ denote an alkyl having 1–20 carbon atoms, a cycloalkyl having 5–20 carbon atoms, an aryl having 6–20 carbon atoms, or an aralkyl having 7–20 carbon atoms.

7. A toner according to claim 5, wherein X denotes hydroxyl, alkyl, aryl, alkoxyl or aryloxyl.

8. A toner according to claim 1, wherein the diorganotin borate is a compound formed through condensation between a diorganotin oxide and boric acid or an organoboric acid.

9. A toner according to claim 8, wherein the diorganotin oxide is a compound represented by the formula:

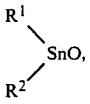

wherein $R^1$ and $R^2$ denote the same or different organic groups.

10. A toner according to claim 9, wherein $R^1$ and $R^2$ denote an alkyl having 1–20 carbon atom, a cycloalkyl having 5–20 carbon atoms, an aryl having 6–20 carbon atoms, or an aralkyl having 7–20 carbon atoms.

11. A toner according to claim 8, wherein the diorganotin borate is a compound formed through a reaction under heating of a mixture of a diorganotin oxide and boric acid or an organoboric acid in a mol ratio of 3:1 to 1:3.

12. A toner according to claim 11, wherein the diorganotin borate is a compound formed through a reaction between 3 mol parts of a diorganotin oxide and 2–3 mol parts of boric acid.

13. A toner according to claim 1, wherein 0.1–20 wt. parts of the diorganotin borate is contained per 100 wt. parts of the binder resin.

14. A toner according to claim 13, wherein 0.5–10 wt. parts of the diorganotin borate is contained per 100 wt. parts of the binder resin.

15. A toner according to claim 1, wherein the binder resin has an acid value of 0.01–50.

16. A toner according to claim 15, wherein the binder resin comprises a mixture of a resin having an acid value and a resin having substantially no acid value.

17. A positively chargeable developer for developing electrostatic images, comprising:

a toner comprising a binder resin, a colorant or magnetic material, and a diorganotin borate; and a positively chargeable silica fine powder.

18. The developer according to claim 17, wherein the positively chargeable silica fine powder has been treated with a silicone oil having an organic group containing at least one nitrogen atom, a silane coupling agent having a nitrogen atom, or a combination of the silicone oil and the silane coupling agent.

19. The developer according to claim 18, wherein the silicone oil has a partial structure of:

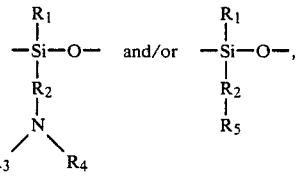

wherein $R_1$ denotes hydrogen, alkyl, aryl or alkoxyl; $R_2$ denotes alkylene or phenylene; $R_3$ and $R_4$ denotes hydrogen, alkyl, a nitrogen-containing heterocyclic group or aryl; and $R_5$ denotes a nitrogen-containing heterocyclic group.

20. The developer according to claim 18, wherein the silane coupling agent is a compound represented by the formula:

$$R_mSiY_n,$$

wherein R denotes alkoxyl or halogen, Y denotes an organic group having at least one amino group or nitrogen atom, and m and n are integers of 1–3 satisfying the relationship of m+n=4.

21. The developer according to claim 17, wherein the positively chargeable fine silica powder is contained in a proportion of 0.01–20 wt. % based on the toner weight.

22. The developer according to claim 21, wherein the positively chargeable silica fine powder is contained in a proportion of 0.03–5 wt. % based on the toner weight.

23. The developer according to claim 17, wherein the diorganic borate has a partial structure of

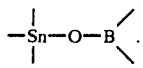

24. The developer according to claim 23, wherein the diorganic borate has a partial structure of

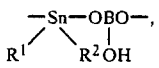

wherein $R^1$ and $R^2$ denote the same or different organic groups.

25. The developer according to claim 24, wherein $R^1$ and $R^2$ denote an alkyl having 1–20 carbon atoms, a cycloalkyl having 5–20 carbon atoms, an aryl having 6–20 carbon atoms, or an aralkyl having 7–20 carbon atoms.

26. The developer according to claim 17, wherein the diorganic borate comprises a compound selected from the group consisting of those represented by the following formulas:

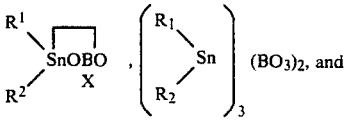

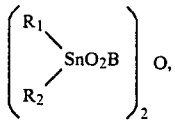

wherein $R^1$ and $R^2$ denote the same or different organic groups, and X denotes a monovalent group.

27. The developer according to claim 26, wherein $R^1$ and $R^2$ denote an alkyl having 1–20 carbon atoms, a cycloalkyl having 5–20 carbon atoms, an aryl having 6–20 carbon atoms, or an aralkyl having 7–20 carbon atoms.

28. The developer according to claim 26, wherein X denotes hydroxyl, alkyl, aryl, alkoxyl or aryloxyl.

29. The developer according to claim 17, wherein the diorganic borate is a compound formed through condensation between a diorganotin oxide and boric acid or an organoboric acid.

30. The developer according to claim 29, wherein the diorganotin oxide is a compound represented by the formula:

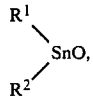

wherein $R^1$ and $R^2$ denote the same or different organic atoms.

31. The developer according to claim 30, wherein $R^1$ and $R^2$ denote an alkyl having 1–20 carbon atoms, a cycloalkyl having 5–20 carbon atoms, an aryl having 6–20 carbon atoms, or an aralkyl having 7–20 carbon atoms.

32. The developer according to claim 29, wherein the diorganotin borate is a compound formed through a reaction under heating of a mixture of a diorganotin oxide and boric acid or an organoboric acid in a mol ratio of 3:1 to 1:3.

33. The developer according to claim 32, wherein the diorganotin borate is a compound formed through a reaction between 3 mol parts of a diorganotin oxide and 2–3 mol parts of boric acid.

34. The developer according to claim 17, wherein 0.1–20 wt. parts of the diorganotin borate is contained per 100 wt. parts of the binder resin.

35. The developer according to claim 34, wherein 0.5–10 wt. parts of the diorganotin borate is contained per 100 wt. parts of the binder resin.

36. The developer according to claim 17, wherein the binder resin comprises a styrene resin, a styrene copolymer, an acrylic resin or a polyester resin.

37. The developer according to claim 36, wherein the binder resin has an acid value of 0.01–50.

38. The developer according to claim 37, wherein the binder resin comprises a mixture of a resin having an acid value and a resin having substantially no acid value.

39. A toner according to claim 1, wherein the binder resin comprises a styrene copolymer selected from the group consisting of styrene-butyl acrylate copolymers, styrene-butyl methacrylate copolymers and styrene-2-ethylhexylacrylate copolymers.

40. A toner according to claim 39, wherein the binder resin comprises a crosslinked styrene copolymer.

41. A toner according to claim 1, wherein the magnetic material is contained in the toner in an amount of 20 to 200 parts by weight per 100 parts by weight of the resin component.

42. A toner according to claim 41, wherein the magnetic material is contained in an amount of 40 to 150 parts by weight.

43. A toner according to claim 1, which has an average particle size of 5 to 20μ.

44. The developer according to claim 17, wherein the binder resin is selected from the group consisting of homopolymers of styrene, homopolymers of styrene derivative, styrene copolymers, acrylic resins and polyester resins.

45. The developer according to claim 44, wherein the binder resin comprises a styrene copolymer selected from the group consisting of styrene-butyl arylate copolymers, styrene-butyl methacrylate copolymers and styrene-2-ethylhexyl acrylate copolymers.

46. The developer acording to claim 45, wherein the binder resin comprises a crosslinked styrene copolymer.

47. The developer according to claim 17, wherein the toner has an average particle size of 5 to 20μ and the positively chargeable silica fine powder having a specific surface area as measured by the BET method with nitrogen adsorption of $30m^2/g$ or more.

48. The developer according to claim 47, wherein the positively chargeable silica fine powder having a specific surface area of 50 to $400m^2/g$.

49. The developer according to claim 44, wherein the positively chargeable silica fine powder has hydrophobicity of 30 to 80 as measured by the methanol titration test.

50. The developer according to claim 17, wherein the magetic material is contained in the toner in an amount of 20 to 200 parts by weight per 100 parts by weight of the resin component.

51. The developer according to claim 50, wherein the magnetic material is contained in an amount of 40 to 150 parts by weight.

* * * * *

UNITED STATES PATENT AND TRADEMARK OFFICE

CERTIFICATE OF CORRECTION

PATENT NO. : 4,737,432

DATED : April 12, 1988

INVENTOR(S) : KATSUHIKO TANAKA, ET AL.

It is certified that error appears in the above-identified patent and that said Letters Patent is hereby corrected as shown below:

COLUMN 4

Line 53, "3A and 3B," should read --2B and 3B,--.

COLUMN 8

Line 5, "O." should read --O,--.

Lines 15-16, " 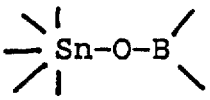 " should read -- 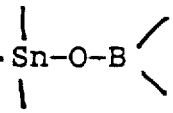 --.

COLUMN 21

Line 10, "85%," should read --85% RH,--.
Line 16, "10%," should read --10% RH,--.
Line 48, "85%," should read --85% RH,--.

COLUMN 24

Table 2, "85%" should read --85% RH--.
Table 2, "10%" should read --10% RH--.
Table 2,

| | | | | | | | |
|---|---|---|---|---|---|---|---|
| " | 9 | 1.37 | ○ | ○ | 1.43 | ○ | ○ " |
| Comparative 1 | 0.87 | △ | △ | 0.90 | △ | △ | |

should read --

| | | | | | | | |
|---|---|---|---|---|---|---|---|
| | 9 | 1.37 | ○ | ○ | 1.43 | ○ | ○ --. |
| Comparative | 1 | 0.87 | △ | △ | 0.90 | △ | △ |

COLUMN 27

Table 4, "85%" should read --85% RH--.
Table 4, "10%" should read --10% RH--.

UNITED STATES PATENT AND TRADEMARK OFFICE

CERTIFICATE OF CORRECTION

PATENT NO. : 4,737,432

DATED : April 12, 1988

INVENTOR(S) : KATSUHIKO TANAKA, ET AL.

It is certified that error appears in the above-identified patent and that said Letters Patent is hereby corrected as shown below:

COLUMN 29

Table 6, "85%" should read --85% RH--.
Table 6, "10%" should read --10% RH--.

COLUMN 32

Line 4, "80%, and 15° C. and 10%," should read --80% RH, and 15° C. and 10% RH,--.

COLUMN 33

Line 19, "85% and 15° C.-10%," should read --85% RH and 15° C.-10% RH,--.
Line 38, "80% and 15° C.-10%," should read --80% RH and 15° C.-10% RH,--.

COLUMN 34

Line 47, "85%," should read --85% RH,--.
Line 53, "10%," should read --10% RH,--.

COLUMN 35

Line 11, "85% and 15° C.-10%," should read --85% RH and 15° C.-10% RH,--.
Line 21, "$(C_4H_9)_2SnO)$" should read --$((C_4H_9)_2SnO)$--.

UNITED STATES PATENT AND TRADEMARK OFFICE

CERTIFICATE OF CORRECTION

PATENT NO. : 4,737,432

DATED : April 12, 1988

INVENTOR(S) : KATSUHIKO TANAKA, ET AL.

It is certified that error appears in the above-identified patent and that said Letters Patent is hereby corrected as shown below:

COLUMN 36

Lines 19-20, "80%, and 15° C. and 10%," should read --80% RH, and 15° C. and 10% RH,--.

COLUMN 37

Lines 9-10, "80%, and 15° C. and 10%," should read --80% RH, and 15° C. and 10% RH,--.
Line 60, "85%," should read --85% RH,--.
Line 67, "10%," should read --10% RH,--.

COLUMN 38

Line 52, "85% and 15° C.-10%," should read --85% RH and 15° C.-10% RH,--.

COLUMN 40

Line 10, "atom," should read --atoms,--.

COLUMN 41

Line 11, "diorganic borate" should read --diorganotin borate--.
Line 20, "diorganic borate" should read --diorganotin borate--.
Line 35, "diorganic borate" should read --diorganotin borate--.
Line 62, "diorganic borate" should read --diorganotin borate--.

UNITED STATES PATENT AND TRADEMARK OFFICE

CERTIFICATE OF CORRECTION

PATENT NO. : 4,737,432

DATED : April 12, 1988

INVENTOR(S) : KATSUHIKO TANAKA, ET AL.

It is certified that error appears in the above-identified patent and that said Letters Patent is hereby corrected as shown below:

COLUMN 42

Line 61, "arylate" should read --acrylate--.

COLUMN 43

Line 6, "having" should read --has--.
Line 8, "claim 44," should read --claim 48,--.

COLUMN 44

Line 3, "magetic" should read --magnetic--.

Signed and Sealed this

Twenty-fourth Day of January, 1989

*Attest:*

DONALD J. QUIGG

*Attesting Officer*

*Commissioner of Patents and Trademarks*